US011187079B2

(12) United States Patent
Van Zuilekom et al.

(10) Patent No.: US 11,187,079 B2
(45) Date of Patent: Nov. 30, 2021

(54) FLUID SATURATED FORMATION CORE SAMPLING TOOL

(71) Applicant: HALLIBURTON ENERGY SERVICES, INC., Houston, TX (US)

(72) Inventors: Anthony Van Zuilekom, Houston, TX (US); Christopher Michael Jones, Houston, TX (US); Darren Gascooke, Houston, TX (US); Michael T. Pelletier, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 7 days.

(21) Appl. No.: 15/579,840

(22) PCT Filed: Jul. 21, 2016

(86) PCT No.: PCT/US2016/043381

§ 371 (c)(1),
(2) Date: Dec. 5, 2017

(87) PCT Pub. No.: WO2018/017103

PCT Pub. Date: Jan. 25, 2018

(65) Prior Publication Data

US 2018/0371904 A1 Dec. 27, 2018

(51) Int. Cl.
*E21B 49/06* (2006.01)
*E21B 49/10* (2006.01)

(52) U.S. Cl.
CPC ..... *E21B 49/06* (2013.01); *E21B 49/10* (2013.01)

(58) Field of Classification Search
CPC ..... E21B 49/06; E21B 25/00–18; E21B 49/10
See application file for complete search history.

(56) References Cited

U.S. PATENT DOCUMENTS

| | | | | |
|---|---|---|---|---|
| 3,664,438 | A * | 5/1972 | Winget | B63C 11/52 175/6 |
| 4,635,717 | A | 1/1987 | Jageler | |
| 5,609,205 | A * | 3/1997 | Massie | E21B 49/081 166/163 |
| 7,128,144 | B2 | 10/2006 | Fox et al. | |
| 7,650,937 | B2 | 1/2010 | Fox et al. | |
| 8,235,106 | B2 | 8/2012 | Fox et al. | |
| 8,522,870 | B2 | 9/2013 | Fox et al. | |
| 2007/0215349 | A1 | 9/2007 | Reid et al. | |

(Continued)

OTHER PUBLICATIONS

International Search Report and Written Opinion; PCT Application No. PCT/US2016/043381; dated Jul. 21, 2016.

(Continued)

*Primary Examiner* — D. Andrews
(74) *Attorney, Agent, or Firm* — Polsinelli PC

(57) ABSTRACT

Downhole core sampling apparatus including first and second sealing elements and at least one pump configured to pump wellbore fluid from the annular space defined by the sealing elements. The downhole core sampling apparatus is capable of obtaining formation fluid saturated core samples for laboratory testing and reservoir evaluation. Method and system for obtaining formation fluid saturated core samples from the sidewall of subterranean wellbores is provided.

14 Claims, 12 Drawing Sheets

(56) References Cited

U.S. PATENT DOCUMENTS

| | | | | |
|---|---|---|---|---|
| 2008/0078241 | A1* | 4/2008 | Tchakarov | E21B 49/06 73/152.24 |
| 2010/0258304 | A1 | 10/2010 | Hegeman | |
| 2011/0068787 | A1 | 3/2011 | Freedman et al. | |
| 2011/0107830 | A1* | 5/2011 | Fields | E21B 7/061 73/152.41 |
| 2014/0131033 | A1 | 5/2014 | Galvan-Sanchez et al. | |
| 2014/0367086 | A1 | 12/2014 | Arian et al. | |

OTHER PUBLICATIONS

Office Action; Brazilian Application No. BR112018076464-7; dated Jun. 23, 2020.

* cited by examiner

FLUID SATURATED FORMATION CORE SAMPLING TOOL

CROSS-REFERENCE TO RELATED APPLICATIONS

This application is a national stage entry of PCT/US2016/043381 filed Jul. 21, 2016, said application is expressly incorporated herein in its entirety.

FIELD

The present disclosure relates to obtaining core samples from subterranean wellbores. In particular, the present disclosure relates to fluid saturated core sampling from the side wall of subterranean wellbores.

BACKGROUND

Wellbores are drilled into the earth for a variety of purposes including tapping into hydrocarbon bearing formations to extract the hydrocarbons for use as fuel, lubricants, chemical production, and other purposes. Core samples may be collected from the wellbore to facilitate evaluation of subterranean reservoirs and formation fluids. In particular, core samples saturated with formation fluid are useful because they may be used to measure formation fluid chemistry, including reactive fluid components, as well as permeability, relative permeability, and capillary pressure. Accurate measurements of reactive fluid components, such as mercury and hydrogen sulfide, are often important in determining reservoir value and appropriate production strategies. However, formation fluid measurements from fluid saturated core samples are often limited because core samples can become contaminated with production fluids or other wellbore fluids, such as coring fluid or drilling fluid filtrate, that invade the reservoir rock in contact with the wellbore during drilling or production operations. In particular, higher permeability zones are especially susceptible to invasion by wellbore fluids, including drilling fluids, greatly decreasing the likelihood of obtaining fluid saturated core samples containing a representative reservoir fluid sample.

BRIEF DESCRIPTION OF THE DRAWINGS

In order to describe the manner in which the advantages and features of the disclosure can be obtained, reference is made to embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
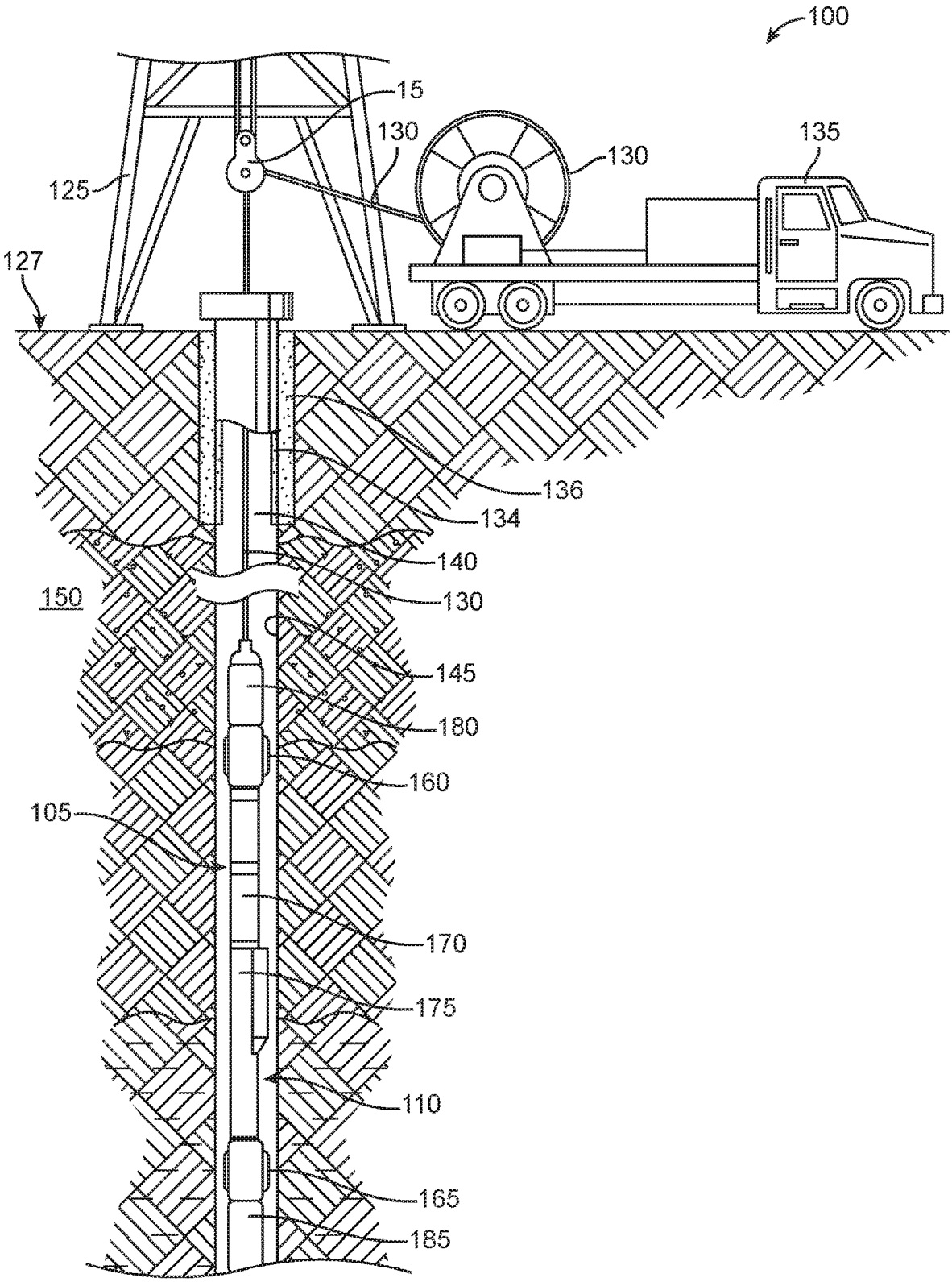
FIG. 1 is a schematic view of a wellbore operating environment in which a downhole core sampling apparatus may be deployed, according to an exemplary embodiment.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed compositions and methods may be implemented using any number of techniques. The disclosure should in no way be limited to the illustrative implementations, drawings, and techniques illustrated herein, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and also may include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream," or "uphole" meaning toward the surface of the wellbore and with "down," "lower," "downward," "downstream," or "downhole" meaning toward the terminal end of the well, regardless of the wellbore orientation. The various characteristics described in more detail below, will be readily apparent to those skilled in the art with the aid of this disclosure upon reading the following detailed description, and by referring to the accompanying drawings.

The present disclosure generally relates to a downhole core sampling apparatus capable of obtaining sidewall core samples saturated with formation fluids. The apparatus can include at least one sealing element capable of isolating an inner portion of the apparatus from at least one outer portion of the apparatus by extending to sealingly engage a wellbore wall.

In some cases, the apparatus includes at least two sealing elements longitudinally spaced apart from each other and capable of extending to sealingly engage a wellbore wall. Upon extension, the sealing elements isolate an inner portion of the apparatus from at least one outer portion of the apparatus. The apparatus further includes a sidewall coring tool coupled with the inner isolatable portion of the apparatus and further coupled with a core storage assembly having a chamber for storing one or more core samples. The apparatus also includes at least one intake port along the inner isolatable portion of the apparatus that is fluidly coupled with an exit port along an outer portion of the apparatus. The apparatus further includes at least one pump configured to pump fluid from the intake port to the exit port when the sealing members are extended to isolate the inner isolatable portion of the apparatus from an outer portion of the apparatus.

The presently disclosed downhole core sampling apparatus, may be used to pump fluids from the near wellbore environment causing drilling fluid and other invasive fluids to be flushed from sample zones of interest and providing for subsequent sampling of core samples saturated with formation fluids from the flushed zones. Core samples collected by the sidewall coring tool are stored in a core storage assembly that includes a pressurized chamber such that fluid is not lost from the core samples during the trip out of the wellbore. The formation fluid saturated sample cores, obtained using the presently disclosed core sampling apparatus, allow for the sampling of reactive formation fluid components, such as mercury and hydrogen sulfide, as well as the measurement of formation fluid chemistry, permeability, capillary pressure and other attributes useful for reservoir evaluation.

FIG. 1 illustrates a schematic view of an embodiment of a wellbore operating environment in which a downhole core sampling apparatus, method, and system may be deployed. As depicted, the operating environment 100 includes a derrick 125 that supports a hoist 115. Drilling oil and gas wells is commonly carried out using a string of drill pipes connected together so as to form a drilling string that is lowered through a rotary table into a wellbore 140. Here it is assumed that the drill string has been temporarily removed from the wellbore 140 to allow a downhole core sampling apparatus 105 to be lowered into the wellbore 140 that has been previously drilled through one or more formations 150.

As depicted, downhole core sampling apparatus 105 can be lowered into wellbore 140 by wireline conveyance 130 coupled with hoist 115. A casing 134 can be secured within the wellbore 140 by cement 136. The wireline conveyance 130 can be anchored to the derrick 125 or portable or mobile units such as a truck 135. The wireline conveyance 130 provides support for the downhole core sampling apparatus 105, as well as enabling communication between the downhole core sampling apparatus 105 and processors or controllers at the surface 127 outside the wellbore 140. The wireline conveyance 130 can be one or more wires, wireline, slickline, cables, tubulars, or the like. The wireline conveyance 130 can include fiber optic cabling or other wire or cable for carrying out communications. The optical cable can be provided internal or external of the conveyance 130. The wireline conveyance 130 is sufficiently strong and flexible to tether the downhole core sampling apparatus 105 through the wellbore 140, while also permitting communication through the wireline conveyance 130 to processors or controllers at the surface 127. Additionally, power can be supplied via the wireline conveyance 130 to meet the power requirements of the downhole core sampling apparatus 105. While a wireline conveyance 130 is illustrated in FIG. 1, other conveyances may be used to convey the core sampling apparatus 105 into the wellbore. In some instances, the core sampling apparatus 105 can be conveyed by wired coiled tubing.

As depicted in FIG. 1, the downhole core sampling apparatus 105 is lowered into wellbore 140 penetrating one or more formations 150 to a desired core sampling zone after which the downhole core sampling apparatus 105 may sample cores from the sidewall 145 of wellbore 140. The core sampling apparatus 105 can include an elongate housing 110, a first sealing element 160, a second sealing element 165, a sidewall coring tool 170, a core storage assembly 175, first pump 180, and second pump 185.

While FIG. 1 depicts a first sealing element 160 and a second sealing element 165, a downhole core sampling apparatus 105 that includes only a single sealing element is within the spirit and scope of the present disclosure. For instance, the downhole core sampling apparatus 105 may include only the first sealing element 160. In other cases, the downhole core sampling apparatus 105 may include only the second sealing element 165.

Although FIG. 1 depicts a vertical wellbore 140, the present disclosure is equally well-suited for use in wellbores having other orientations including horizontal wellbores, slanted wellbores, multilateral wellbores or the like. Also, even though FIG. 1 depicts an onshore operation, the present disclosure is equally well-suited for use in offshore operations.

FIG. 1 illustrates just one embodiment of a wellbore operating environment in which a downhole core sampling apparatus, method, and system may be deployed. The core sampling apparatus, method, and system may be deployed in other operating environments, such as a drilling environment. For instance, the core sampling apparatus 105 may be placed in a wellbore as part of a measurement while drilling (MWD) portion of a drillstring or as part of a logging while drilling (LWD) portion of a drillstring. In other instances, the core sampling apparatus 105 may be on a drillpipe as part of a wired drillpipe system.

Figure 2:
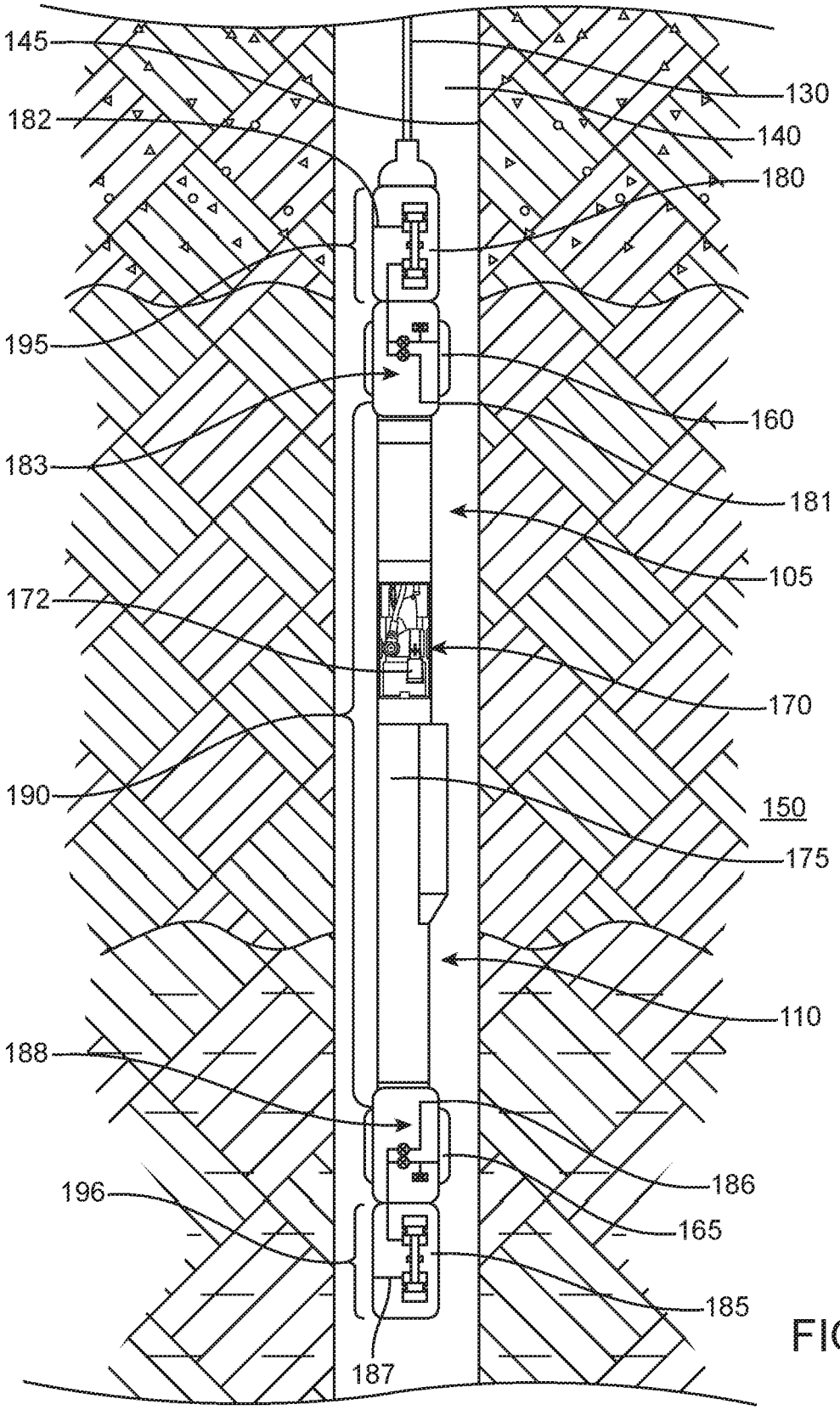
FIG. 2 is a partial cut-away view of a downhole core sampling apparatus in the run configuration, according to an exemplary embodiment.

FIG. 2 illustrates a close-up view of a core sampling apparatus 105 that has been lowered to a sampling depth of interest in wellbore 140 by wireline conveyance 130. As depicted in FIG. 2, the core sampling apparatus 105 includes an elongate housing 110, a first sealing element 160, and a second sealing element 165. The first and second sealing elements 160, 165 are coupled with the elongate housing 110 and are spaced apart from one another along a longitudinal length of the elongate housing 110 to form an isolatable portion 190 of the elongate housing between the first and second sealing elements 160, 165. As depicted in FIG. 2, the core sampling apparatus 105 a first outer portion 195 and a second outer portion 196 spaced apart from one another along a longitudinal length of the elongate housing 110 and separated from one another by the first sealing element 160, the second sealing element 165, and the isolatable portion 190 of the elongate housing 110. The isolatable portion 190 of the core sampling apparatus 105 is isolatable from outer portions 195, 196 of the elongate housing 110 upon extension of the sealing elements 160, 165 to engage a surface of the wellbore. When the first sealing element 160 and the second sealing element 165 are extended substantially perpendicular to the longitudinal length of the elongate housing 110 to engage a surface 145 of the wellbore 140, a sealed annulus region (for example the isolated area 198 of wellbore 140 in FIG. 3) is formed between the surface 145 of the wellbore 140, the first sealing element 160, the second sealing element 165, and the isolatable portion 190 of the elongate housing 110.

As depicted in FIG. 2, sealing elements 160, 165 can be expandable sealing elements capable of expanding to sealingly engage the sidewall 145 of wellbore 140. In such instances, the isolatable portion 190 of the elongate housing 110 is isolatable from outer portions 195, 196 of the elongate housing upon expansion of the expandable sealing elements 160, 165. In some cases, expandable sealing elements 160, 165 may be straddle packers.

Although sealing elements 160, 165 are depicted in FIG. 2 as expandable sealing elements, sealing elements 160, 165 can be any device capable of extending or deploying to isolate a section of the wellbore and sealingly engage the wall 145 of the wellbore 140 so as to provide sufficient isolation of the core sampling zone so that fluid may be pumped from the core sampling zone. For instance, sealing elements 160, 165 can be sealing pads extended or deployed to isolate a section of the wellbore and sealingly engage the wall 145 of the wellbore 140.

The core sampling apparatus 105 further includes a sidewall coring tool 170 coupled along the isolatable portion 190 of the core sampling apparatus 105 and further coupled with a core storage assembly 175 having a chamber for storing a plurality of core samples. The core sampling apparatus 105 additionally includes a first intake port 181 disposed along the isolatable portion 190 of the core sampling apparatus 105. The first intake port 181 is configured to receive fluid into an interior portion 183 of the elongate housing 110. The first intake port 181 is fluidly coupled with a first exit port 182 disposed on a first outer portion 195 of the core sampling apparatus. The first exit port 182 is configured to expel fluid from the interior portion 183 of the elongate housing 110. A first pump 180 is coupled with the first intake port 181 and the first exit port 182. The first pump 180 is configured to draw fluid through the first intake port 181 into the interior portion 183 of the elongate housing 110. The first pump 180 may also be configured to pump fluid from the first intake port 181 to the first exit port 182 when the sealing elements 160, 165 are extended to isolate the isolatable portion 190 of the elongate housing 110.

The core sampling apparatus 105 may optionally include one or more additional intake ports, exit ports, and pumps. For instance, FIG. 2 additionally depicts a second intake port 186 disposed along the isolatable portion 190 of the elongate housing 110. The second intake port 186 is fluidly coupled with a first exit port 187 disposed on a second outer portion 196 of the core sampling apparatus. The second intake port 186 is configured to receive fluid into an interior portion 188 of the elongate housing 110. A second pump 185 is operatively coupled with the second intake port 186 and the second exit port 187. The second exit port 187 is configured to expel fluid from the interior portion 188 of the elongate housing 110. The second pump 185 is configured to draw fluid through the second intake port 186 into the interior portion 188 of the elongate housing 110. The second pump 185 may also be configured to pump fluid from the second intake port 186 to the second exit port 187 when sealing elements 160, 165 are extended to isolate the isolatable portion 190 of the elongate housing 110 from the outer portions 195, 196 of the elongate housing 110.

As depicted in FIG. 2, the core sampling apparatus 105 is in the run configuration suitable for running the core sampling apparatus 105 into the wellbore and lowering to a sampling depth of interest or for subsequent uphole or downhole repositioning in the wellbore to one or more additional desired sampling sites. In the run configuration, the sealing elements 160, 165 are retracted allowing for free movement of the core sampling apparatus 105 within the wellbore 140. As depicted in FIG. 2, the sealing elements 160, 165 are shown as expandable sealing members that are deflated or unexpanded, allowing for free movement of the core sampling apparatus 105 within the wellbore 140.

Figure 3:
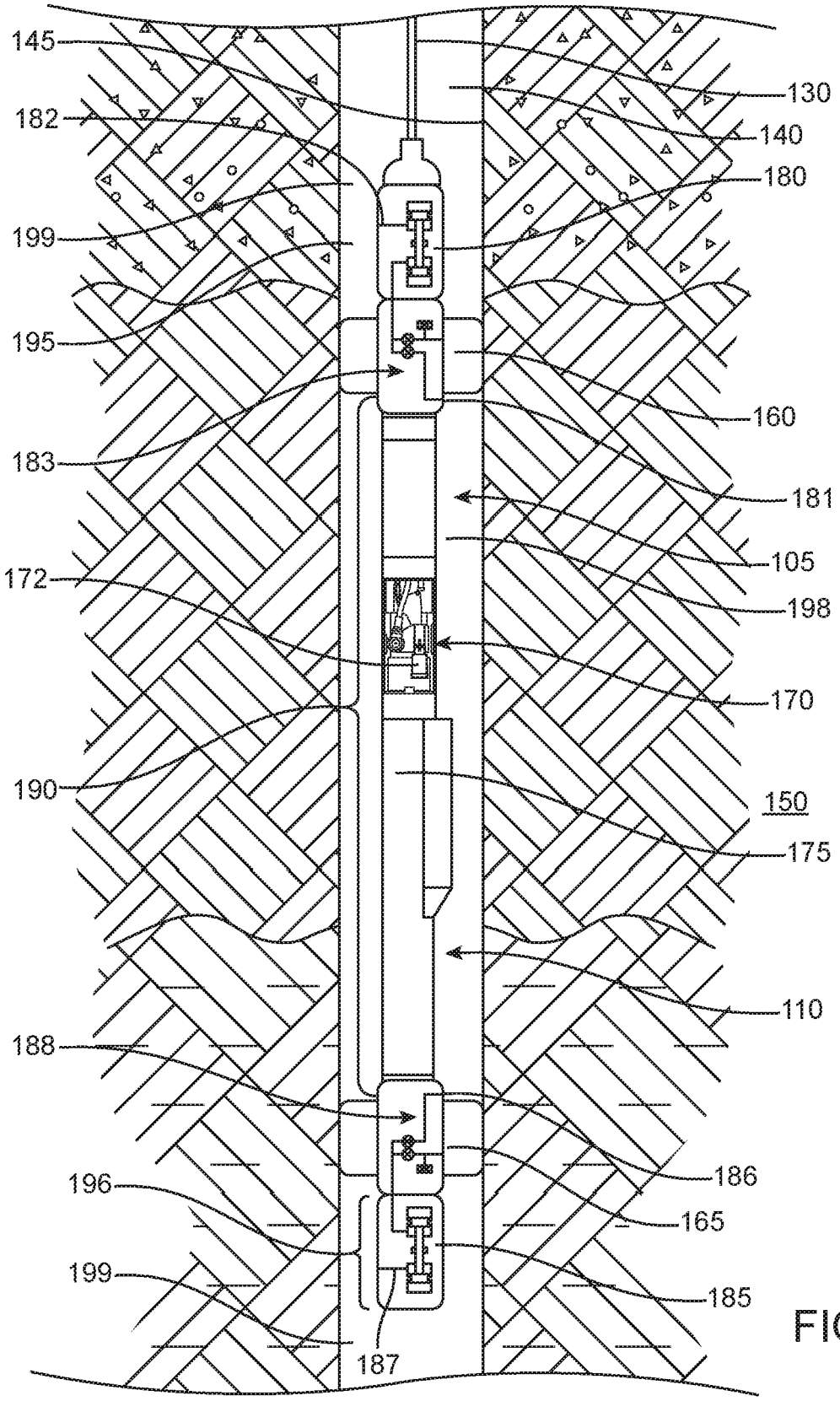
FIG. 3 is a partial cut-away view of a downhole core sampling apparatus in the set configuration, according to an exemplary embodiment.

FIG. 3 illustrates a close-up view of the core sampling apparatus 105 in the set configuration after being lowered to a sampling depth of interest. In the set configuration, the sealing elements 160, 165 are extended to sealingly engage the wall 145 of the wellbore 140 and isolate the isolatable portion 190 of the elongate housing 110. As depicted in FIG. 3, the sealing members 160, 165 can be expandable sealing elements. In such cases, the sealing elements 160, 165 can be extended or expanded into position by inflating the sealing elements 160, 165 with fluid through controlled valves. When expanded, the sealing elements 160, 165 isolate a section of the wellbore and fluid from within the isolated area can be drawn through one or more intake ports located between the sealing elements 160, 165. The sealing elements 160, 165 may be straddle packers, or any other device capable of extending, expanding or deploying to isolate a section of the wellbore and sealingly engage the wall 145 of the wellbore 140 so as to provide sufficient isolation of the core sampling zone so that fluid may be pumped from the core sampling zone. In some cases, the sealing elements 160, 165 may be sealing pads deployed to isolate a section of the wellbore and sealingly engage the wall 145 of the wellbore 140.

Following expansion of the sealing elements 160, 165 to sealingly engage the wall 145 of the wellbore 140, one or more pumps on the core sampling apparatus can be used to pump fluid from within the isolated area 198 of the wellbore 140 and adjacent to the isolatable portion 190 of the elongate housing 110 to outside 199 the isolated area of the wellbore 140 adjacent to the outer portions 195, 196 of the elongate housing 110. As depicted in FIG. 3, the core sampling apparatus 105 includes a first pump 180 operatively coupled with a first intake port 181 disposed along the isolatable portion 190 of the core sampling apparatus 105. The first intake port 181 is fluidly coupled with a first exit port 182 disposed on a first outer portion 195 of the core sampling apparatus 105 and also operatively coupled with the first pump 180. The first pump 180 is configured to pump fluid from the first intake port 181 to the first exit port 182 thereby pumping fluids from the near wellbore environment and flushing drilling fluid and other invasive fluids from the sample zones of interest in the portion of the wellbore isolated by the sealing elements 160, 165. The first pump 180 is further configured to pump fluid from the isolated portion 198 of the wellbore 140 with sufficient pressure so as to draw formation fluid within the sample zones of interest toward the wall 145 of the wellbore 140 such that subsequent sampling of core samples from the sample zone of interest provides for core samples saturated with representative formation fluids.

The core sampling apparatus 105 may optionally include one or more additional pumps operatively coupled to one or more intake ports and exit ports. For instance, FIG. 3 additionally depicts a second intake port 186 disposed along the inner isolatable portion 190 of the elongate housing 110. The second intake port 186 is fluidly coupled with a first exit port 187 disposed on a second outer portion 196 of the elongate housing 110. A second pump 185 is operatively coupled with the second intake port 186 and the second exit port 182. The second pump 185 is configured to pump fluid from the second intake port 186 to the second exit port 187 when sealing members 160, 165 are extended to isolate the inner isolatable portion 190 of the elongate housing 110 from the outer portions 195, 196 of the elongate housing 110. In a similar manner as the first pump 180, the pumping of second pump 185 flushes drilling fluid and other invasive fluids from the sample zones of interest in the portion of the wellbore isolated by sealing members 160, 165. The second pump 180 is further configured to pump fluid from the isolated portion 198 of the wellbore 140 with sufficient pressure so as to draw formation fluid within the sample zones of interest toward the wall 145 of the wellbore 140 such that subsequent sampling of core samples from the sample zone of interest provides for core samples saturated with representative formation fluids.

Figure 4:
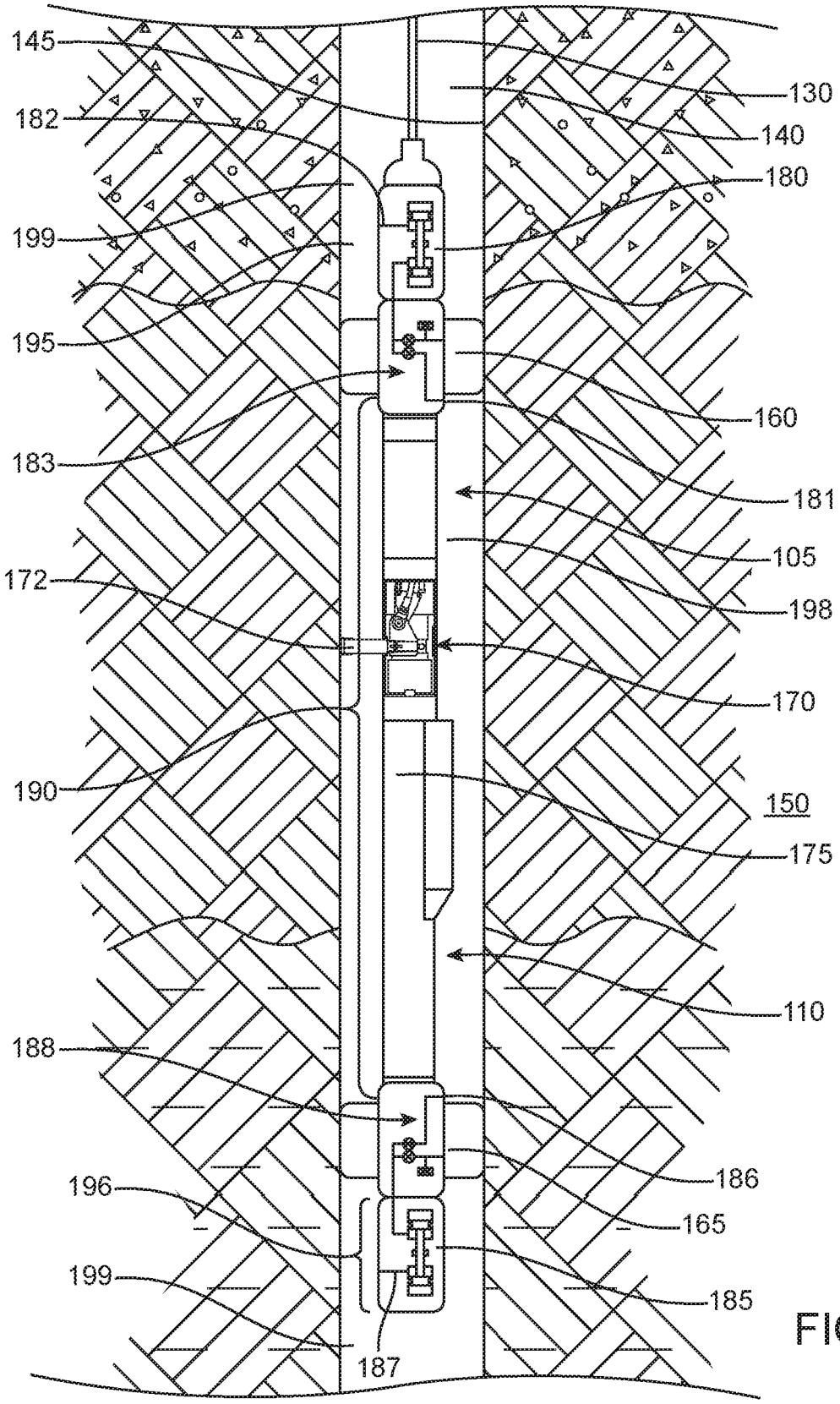
FIG. 4 is a partial cut-away view of a downhole core sampling apparatus in the set configuration with a sidewall coring tool in drilling engagement with the wellbore, according to an exemplary embodiment.

While two pumps and two intake ports and exit ports are depicted in FIGS. 2-4, the core sampling apparatus 105 may include a single pump operatively coupled to a single intake port and exit port without departing from the spirit and scope of the present disclosure. Additionally, the core sampling apparatus 105 may include more than two pumps, each operatively coupled to at least one intake port and exit port, without departing from the spirit and scope of the present disclosure.

FIG. 4 illustrates the core sampling apparatus 105 in the set configuration with a sidewall coring tool 170 in drilling engagement with the wellbore. The sidewall coring tool 170 is coupled along the inner isolatable portion 190 of the elongate housing 110 and further coupled with a core storage assembly 175 having a chamber for storing a plurality of core samples. Once the core sampling apparatus 105 is lowered to a sample region of interest, the sealing elements 160, 165 are extended to sealingly engage wall 145 of wellbore 140, and one or more pumps have flushed sample zone, the coring bit 172 of sidewall coring tool 170 is rotated to face the wall 145 of the wellbore 140. Subsequently, the coring bit 172 is extended to engage the wall 145 of the wellbore 140 so that a formation fluid saturated core sample may be cut and extracted from wall 145 of wellbore 140. Formation fluid saturated core samples collected by the sidewall coring tool 170 are stored in a pressurized chamber within the core storage assembly 175 such that fluid is not lost from the core samples during the trip out of the wellbore.

According to at least one aspect of the present disclosure, after one or more core samples are collected and stored in the core sampling apparatus 105, the sealing elements 160, 165 can be retracted or deflated and the sidewall coring bit 172 retracted to allow the apparatus to be moved to a new sampling location within wellbore 140. After each time that the core sampling apparatus 105 is moved to an additional sampling location within wellbore 140, the sealing elements 160, 165 can be extended to sealingly engage the wall 145 of the wellbore 140, and one or more pumps used to flush fluid from within the isolated area of the wellbore 140 so as to provide for sampling of formation fluid saturated core samples.

Figure 5:
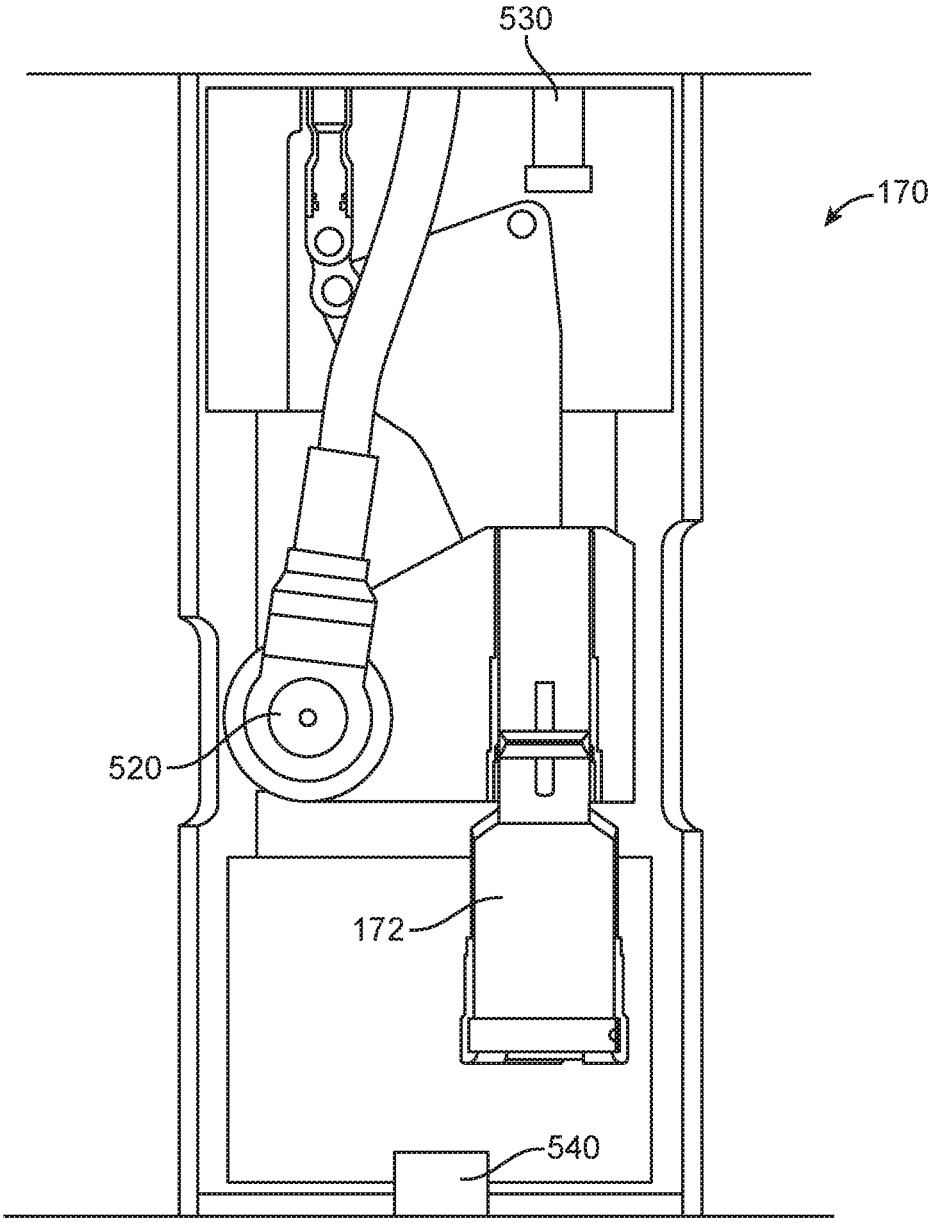
FIG. 5 is a cut-away view of the sidewall coring tool portion of a downhole core sampling apparatus with the coring bit parallel to the sidewall coring tool, according to an exemplary embodiment.
Figure 6:
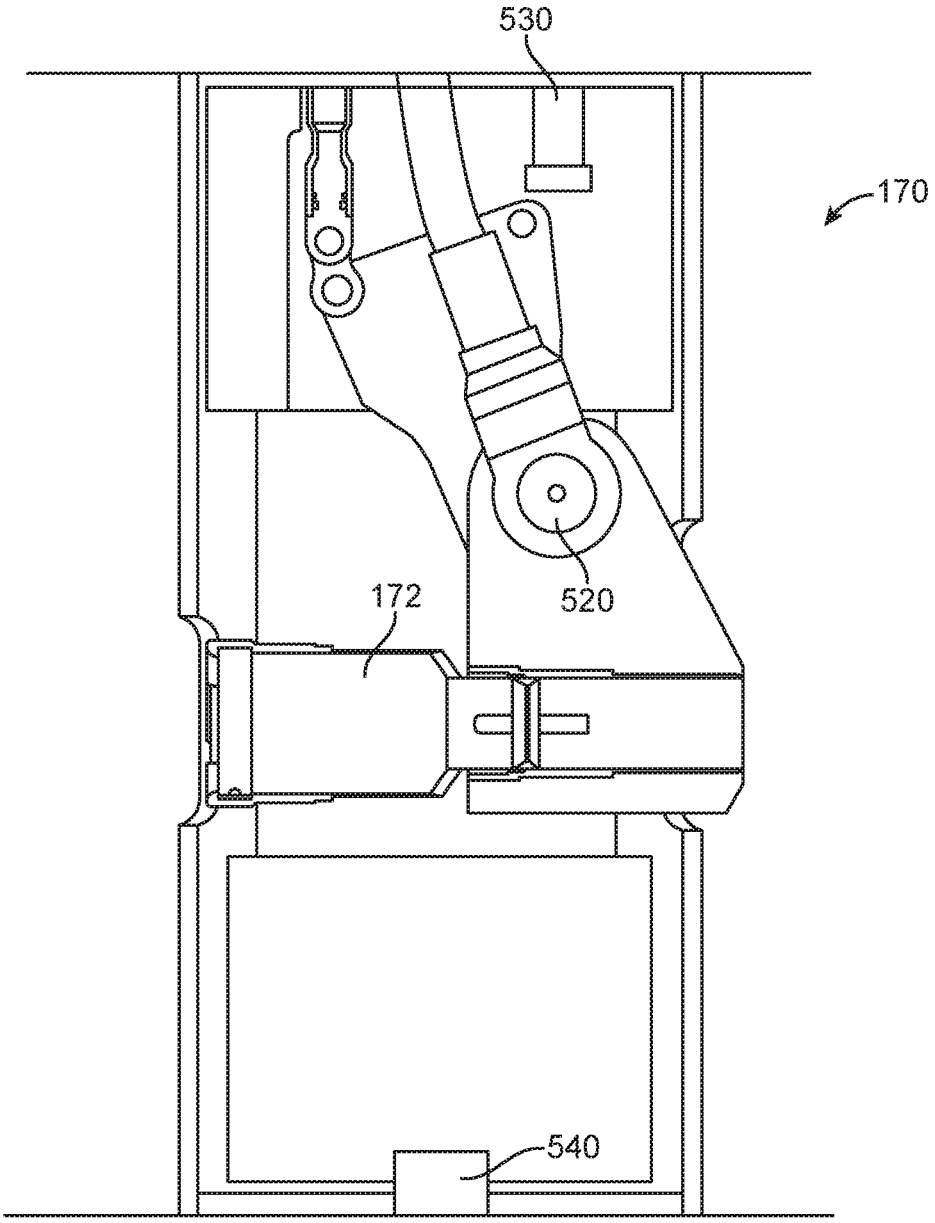
FIG. 6 is a cut-away view of the sidewall coring tool portion of a downhole core sampling apparatus with the coring bit rotated toward the wellbore wall and perpendicular to the sidewall coring tool, according to an exemplary embodiment.
Figure 7:
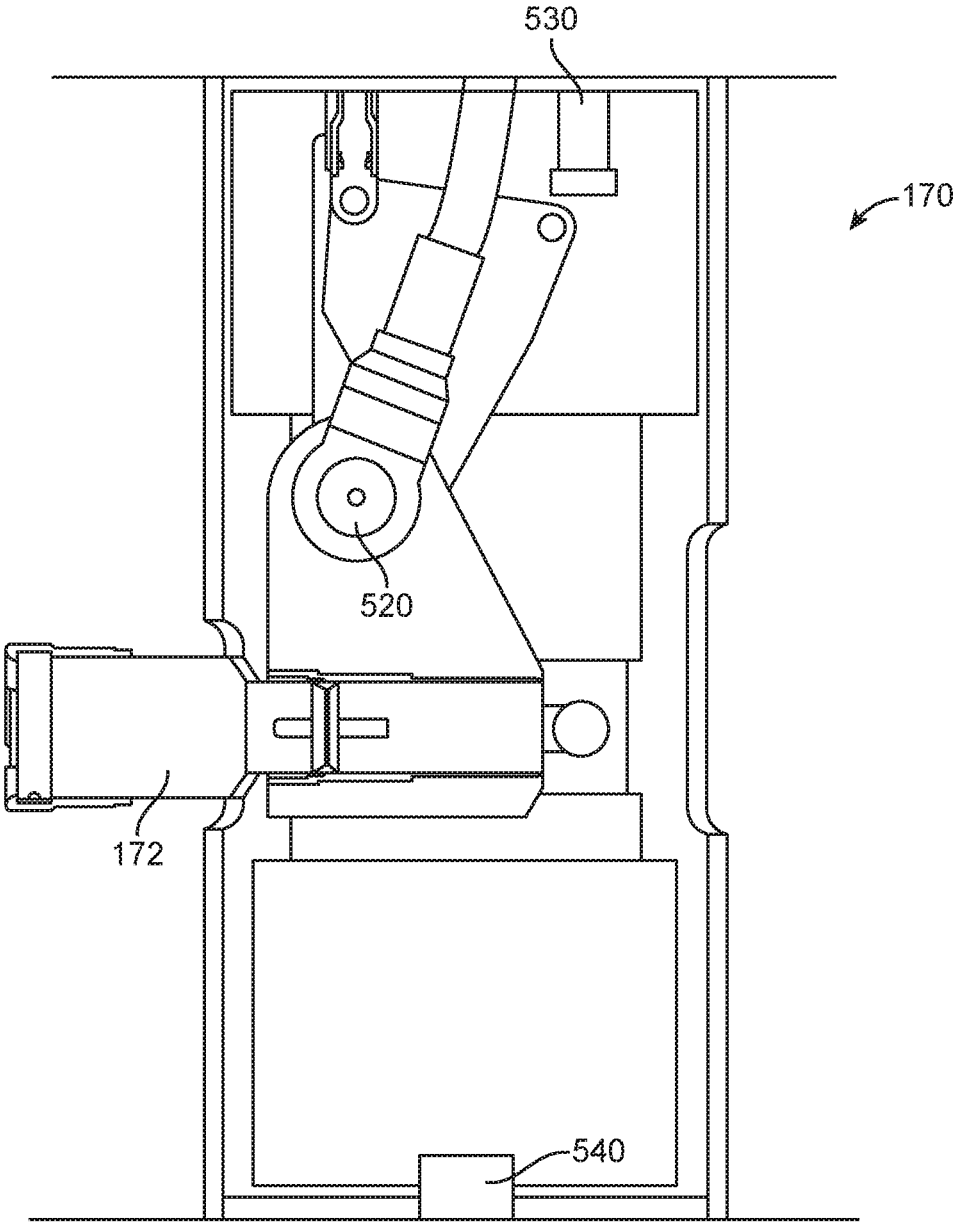
FIG. 7 is a cut-away view of the sidewall coring tool portion of a downhole core sampling apparatus with the coring bit extended toward the wellbore wall, according to an exemplary embodiment.

FIGS. 5-7 illustrate the sidewall coring tool 170 portion of core sampling apparatus 110. As depicted in FIGS. 5-7, the sidewall coring tool 170 includes a coring bit 172 to be forced into a formation so as to collect a formation fluid saturated core sample. Certain example coring bits 172 include a finger in the coring head to retain a sample. The sidewall coring tool can in some instances include a bell crank 520 allowing the coring bit 510 to be both rotated and moved. As shown in FIGS. 5-7, the coring bit 172 is spun while it is translated into the wall 145 of wellbore 140. In some instances, the formation fluid saturated core sample is cut from the wellbore 140 until the tool has reached a maximum displacement into the wellbore wall 145. In some instances, a sharp lateral translation of the tool and core barrel assembly will break the core sample free from the wellbore wall 145 corresponding to the formation 150.

The sequence of FIGS. 5-7 can be reversed as the coring bit 172 is retracted back into the core sampling apparatus 105 and then rotated parallel to the core sampling apparatus 105. In some instances, the coring bit 172 can be aligned with an opening 540 in core storage assembly 175 upon retraction. The collected core is pushed into the opening 540 of the core storage assembly 175 by, for example, plunger 530.

Figure 8:
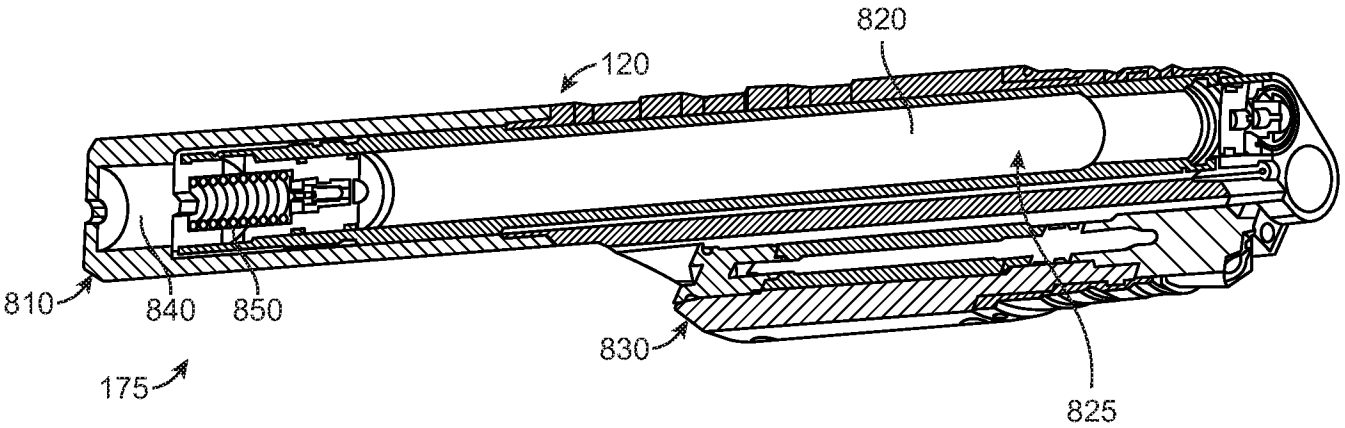
FIG. 8 is a cut-away view of a core storage assembly portion of a downhole core sampling apparatus, according to an exemplary embodiment.

FIG. 8 illustrates a core storage assembly 175 of a core sampling apparatus 110, according to an exemplary embodiment. The core storage assembly 175 includes a core tube assembly 810, which, in turn, includes a carrier chamber 820 to store a plurality of core samples. The core tube assembly 810 further includes a cover action mechanism 830 to open and close the opening to the carrier chamber 820. The core storage assembly 175 may include a chemical chamber 840 for storing one or more chemicals for use with the core samples.

The core storage assembly 175 is configured to store the cores after they are retrieved from the formation 150 by sidewall coring tool 170. The cores are stored within the carrier chamber 820 of the core storage assembly 175. In some instances, the sidewall coring tool 170 may be a Hostile Rotary Sidewall Coring (HR-SCT™) tool by Halliburton Energy Services, Inc. In some instances, the core storage assembly 175 includes two sections. The first section is an activation mechanism module 830 and the second section is a core tube assembly 810.

Figure 9:
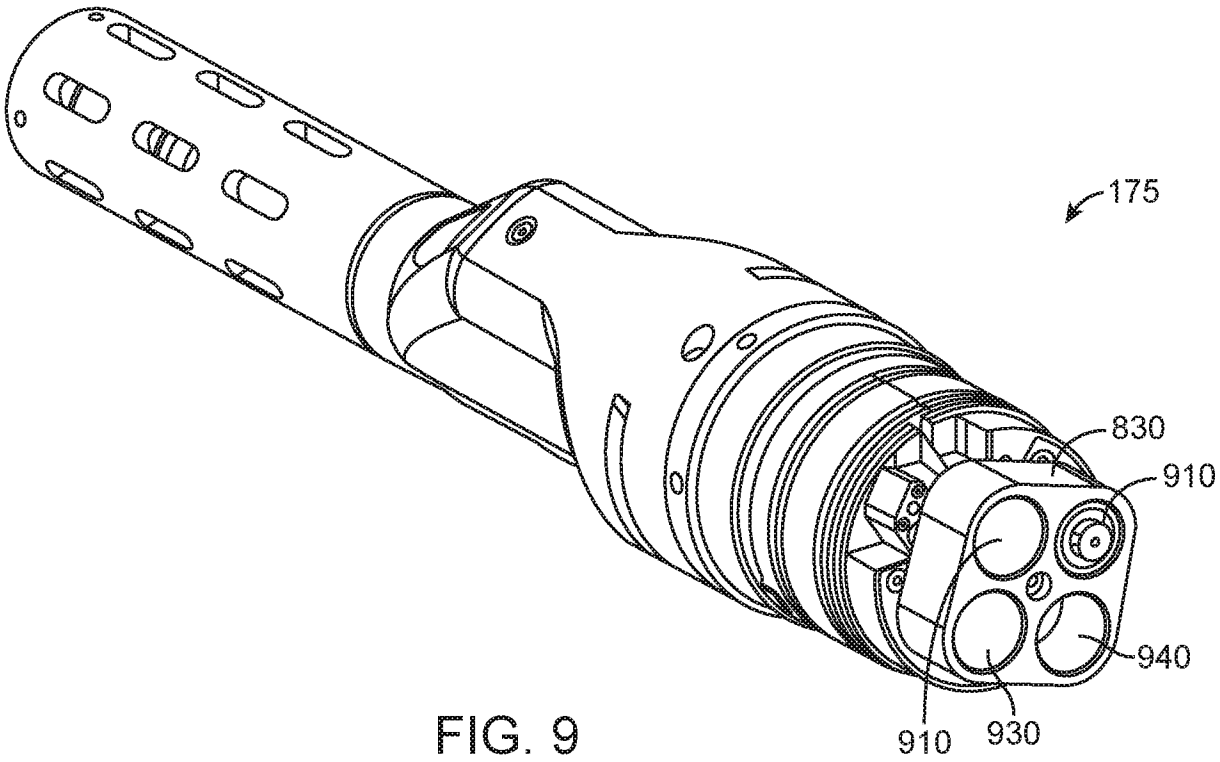
FIG. 9 is an elevation view of a cover activation mechanism portion of a downhole core sampling apparatus, according to an exemplary embodiment.

FIG. 9 illustrates a cover activation mechanism 830 shown from outside the tool, according to an exemplary embodiment. The cover activation mechanism 830 may be actuated to place one of a cover 910 or the contents of one of chambers 920, 930, or 940 in front of the core storage assembly 175. In some instances the core storage assembly 175 may include fewer than four chambers, while in other instances, the core storage assembly 175 may include four, five, six, seven, eight, nine, ten, eleven, twelve, thirteen, fourteen, fifteen, or more chambers. Example ones of chambers 920, 930, and 940 may include one or more of isolator plugs, packaging film, or other items for preserving core samples.

In some cases, the cover activation mechanism 830 is actuated by a rotational motor, which may be a geared motor or servo. In other instances, the cover activation mechanism is actuated by a cable with a spring.

In some cases, when the core sampling apparatus 105 is in coring mode, a cover activation mechanism 830 rotates the cover to the open position which allows the sampled core to be deposited into the carrier chamber 820 of the core storage assembly 175. In some instances, after each core is drilled and deposited in the carrier chamber 820, the cover activation mechanism 830 rotates the cover to the closed position. Once in the closed position, a push rod within the cover activation mechanism 830 can install a plug 910 through the cover into the carrier chamber 820. The plug 910 may maintain the pressure of the carrier chamber 820, for example, while it is brought to the surface and transported to a laboratory for testing. Once on the surface, the carrier chamber 820 can be removed from the larger assembly and shipped to the lab for further evaluation and testing.

In some instances, the core sampling apparatus 105 obtains two or more sets of core samples from different formation regions in a single run and stores the sets of core samples in the carrier chamber 820. In some instances, a swellable packer may be used to isolate the sets of core samples from each other in the carrier chamber 820. In other instances, the cores may be separated with a disc. The discs can be composed of compliant materials, such as foam. The discs can seal against the walls of the carrier chamber 820 to isolate the core samples and prevent fluid from being transferred between core samples. In some cases, the discs seal chemically to deter the adsorption of mud component or gas exposure. The discs may also help to prevent the core samples from rattling in the core tube and breaking while in transit to the surface or in transit to the lab. The discs may also be used to identify from what location in the wellbore 140 the core sample was taken.

The core tube assembly 810 may include one or more sensors. The sensors may be located at the top or the bottom of the carrier chamber 820. The sensors may measure one or more of temperature, pressure, or acceleration. The one or more sensors may be coupled with a memory to store logged data. For instance, the sensors may be coupled with a memory to store one or more measurements from the sensors. The memory can be further coupled to one or more processors to control the measurements from the sensors and the storage of the measurements in the memory. In some instances, the sensors measure one or more of a temperature, a pressure, or an acceleration during or after storing a core sample in the core storage assembly 175. The system may further store a time associated with the sampling of a core and associate the time with the measured temperature, pressure, or an acceleration. In some cases, the memory is capable of being queried and read at the surface. For instance, the memory may be queried using a computer and a wired or wireless connection to the processor of the core storage assembly 175.

In some instances, the plugging of the carrier chamber 820 is performed after the desired core samples are retrieved and deposited in the carrier chamber 820. In some cases, the plugging of the carrier chamber 820 maintains the pressure of the core samples while the carrier chamber 820 is brought to the surface and after the carrier chamber 820 has been brought to the surface. For instance, the pressure may be maintained at or near in-situ pressure for the formation samples.

In some cases, the core storage assembly 175 may include a carrier chamber 820 filled with a fluid such as nitrogen. In some instances, the bottom of the carrier chamber 820 may be fitted with a piston 850 which is compressed as core samples are loaded into the carrier chamber 820. For instance, as a core sample is loaded into the carrier chamber 820, piston 850 is energized to maintain an axial load on the cores samples. In some cases, piston 850 is a travelling piston or a floating piston. In such cases, an axial load is maintained on the core samples as they are brought to the surface from the pressure maintained by the travel piston.

In some cases, the core storage assembly 175 includes a bladder in the wall of carrier chamber 820. In such cases, the bladder wall is used to maintain an axial load on the core samples, maintaining hydrostatic pressure in the core samples. This bladder wall may help to preserve the strain state of the core sample. The bladder wall may further help to prevent shifting of the core samples during transport and maintain the gas phase of the core samples.

In some cases, the core storage assembly 175 may further include tubing material to receive one or more core samples in the carrier chamber 820. For instance, a thermoplastic such as polyether ether ketone (PEEK) or Teflon may be used as a tubing in the carrier chamber 820. In some cases, the tubing may be arranged like a "sock" with the open end attached to the closed end of the carrier chamber 820. In at least one aspect of the present disclosure, as a core sample is brought into the carrier chamber 820, it is encased in a portion of the tubing. In some instances, a heater may be used to heat shrink a portion of the tubing around the core sample. In some cases, the shrinking and application of a constricting radial load from the tubing seals the core sample. In some cases, this heat shrink sealing helps to retain liquids in the core sample and may further help to prevent sample-to-sample contamination. In some instances where the core samples are stored in tubing material, after a sample is loaded, a sample retainer is rotated once as a sample tamping piston is nearing contact. This seals each of the tubing-material sheathed core samples in an individual compartment.

In some instances, the core tube assembly 810 can include one or more heaters to apply heat to the core samples. The heaters may be controlled based, at least in part, on one or more temperature measurements measured by one or more sensors in the core storage assembly 175. In some cases, the carrier chamber 820 may include one or more heaters at one or both ends of the carrier chamber 820. In some cases, the core tube assembly 810 may include a thin-film heater along at least part of its length to heat core samples.

In some cases, the core storage assembly 175 may maintain both the pressure and the temperature of a core sample. In such cases, gases within the core sample may be kept in solution after the carrier chamber 820 is brought to the surface.

According to at least one aspect of the present disclosure, the carrier chamber 820 of the core storage assembly 175 can be coated with a coating 825 that is unreactive with respect to one or more components of the formation fluid. For instance, the carrier chamber 820 may be coated with a sapphire ($Al_2O_3$) or other coating 825 known to be unreactive in the presence of hydrogen sulfide ($H_2S$) or mercury, such that these reactive formation fluid components are preserved in the formation fluid saturated cores for later analysis. Such protective sampling provides for the measurement of low concentrations of reactive formation fluid components. In at least one aspect of the present disclosure, the sapphire ($Al_2O_3$) coating may be applied using vapor deposition.

In some instances, the core storage assembly 175 includes a sampling chamber with end caps and fittings suitable for installation in a laboratory displacement apparatus. In one instance, the core samples may be stored continuously in a tube lined system where a core end plate with flow fittings is attached to the end of the tube. In some cases, the tube lining may be made of Teflon of PEEK. In an exemplary operation, the core samples are installed in the receiving chamber and a top cap is forced into place as the tube is heat sealed to the top cap. In some cases, the top cap is fitted for laboratory studies, such as flow studies where fluid is flowed into or out of the sampling chamber. In some cases, one or both of axial and radial loads are maintained on the core samples, using techniques described above. Alternatively, one end cap is set to stroke with hydraulic pressure, while the radial component is maintained through a side port through which fluid is injected to maintain the core samples under compression while the samples are conveyed to the surface.

In some cases, a hydraulic support system maintains the stress conditions on the core samples after retrieval and during transportation of the core samples in the sampling chamber to, for example, a laboratory. The radial and axial loads may further be maintained while the sample chamber is installed in lab equipment.

Figure 10:
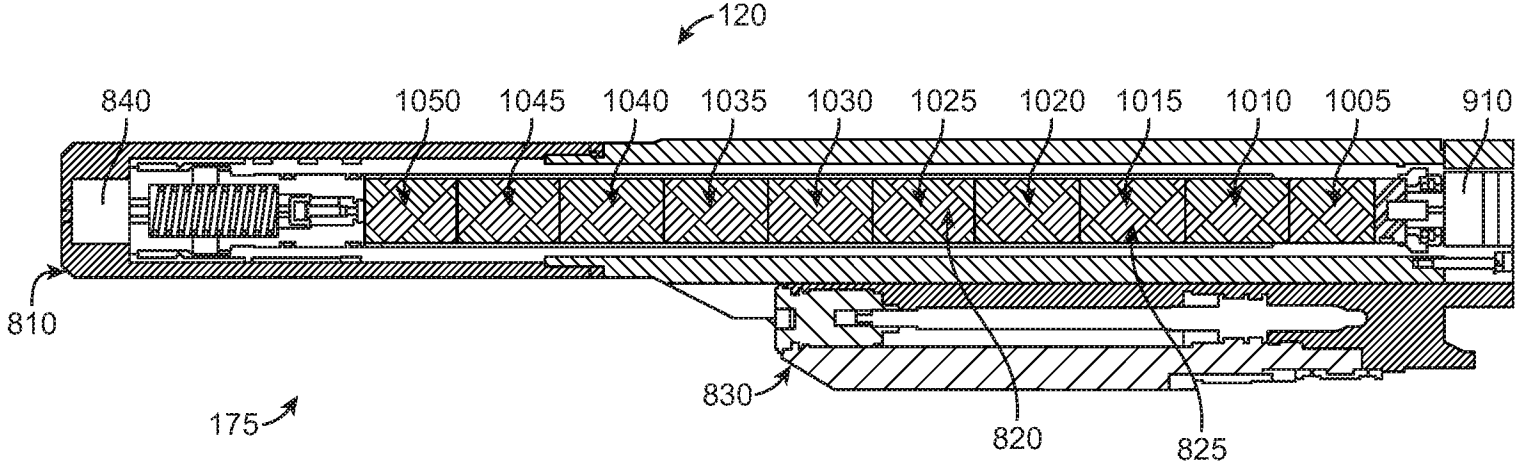
FIG. 10 is a cut-away view of a core storage assembly portion of a downhole core sampling apparatus containing sampled cores, according to an exemplary embodiment.

FIG. 10 illustrates the core storage assembly 175 portion of a core sampling apparatus 105 with the carrier chamber 820 filled with formation fluid saturated cores samples 1005, 1010, 1015, 1020, 1025, 1030, 1035, 1040, 1045, and 1050. Cover 910 has been installed over carrier chamber 820 to maintain pressure within the carrier chamber 820 such that fluid is not lost from the core samples during the trip out of the wellbore.

Figure 11:
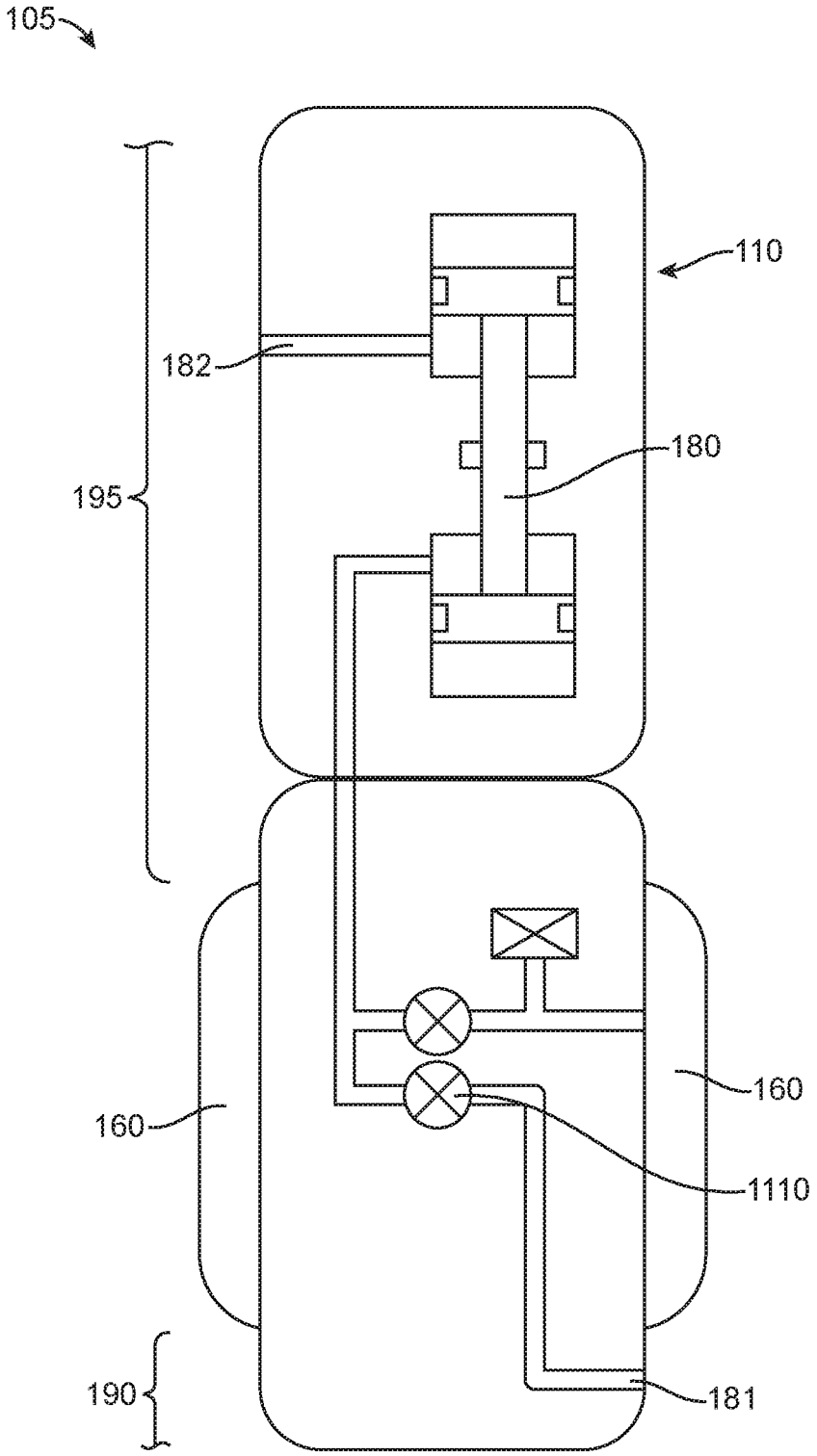
FIG. 11 is a close-up cross-sectional view of a pump and sealing element coupled with a proximal portion of a downhole core sampling apparatus, according to an exemplary embodiment.

FIG. 11 illustrates a close-up cross-sectional view of the first pump 180 and first sealing element 160 coupled with a proximal portion of the core sampling apparatus 105, according to an exemplary embodiment. As depicted in FIG. 11, the first pump 180 is operatively coupled with a first intake port 181 disposed along the isolatable portion 190 of the elongate housing 110. The first intake port 181 is fluidly coupled with a first exit port 182 disposed on a first outer portion 195 of the elongate housing 110 and also operatively coupled with the first pump 180. Optionally, the fluid coupling between the first intake port 181 and the first exit port 182 may include one or more valves 1110 configured to selectively permit and prevent flow of fluid between the first intake port 181 and the first exit port 182. The first pump 180 is configured to pump fluid from the first intake port 181 to the first exit port 182 when the first sealing element 160 and the second sealing element 165 are extended to isolate the isolatable portion 190 of the elongate housing 110 from the outer portions 195, 196 of the elongate housing 110. The pumping action by the first pump 180 serves to flush drilling fluid and other invasive fluids from the sample zones of interest in the portion of the wellbore isolated by the expanding sealing elements 160, 165. The first pump 180 is further configured to pump fluid from the isolated portion 198 of the wellbore with sufficient pressure so as to draw formation fluid within the sample zones of interest toward the wall 145 of the wellbore 140 such that subsequent sampling of core samples from the sample zone of interest provides for core samples saturated with representative formation fluids.

Figure 12:
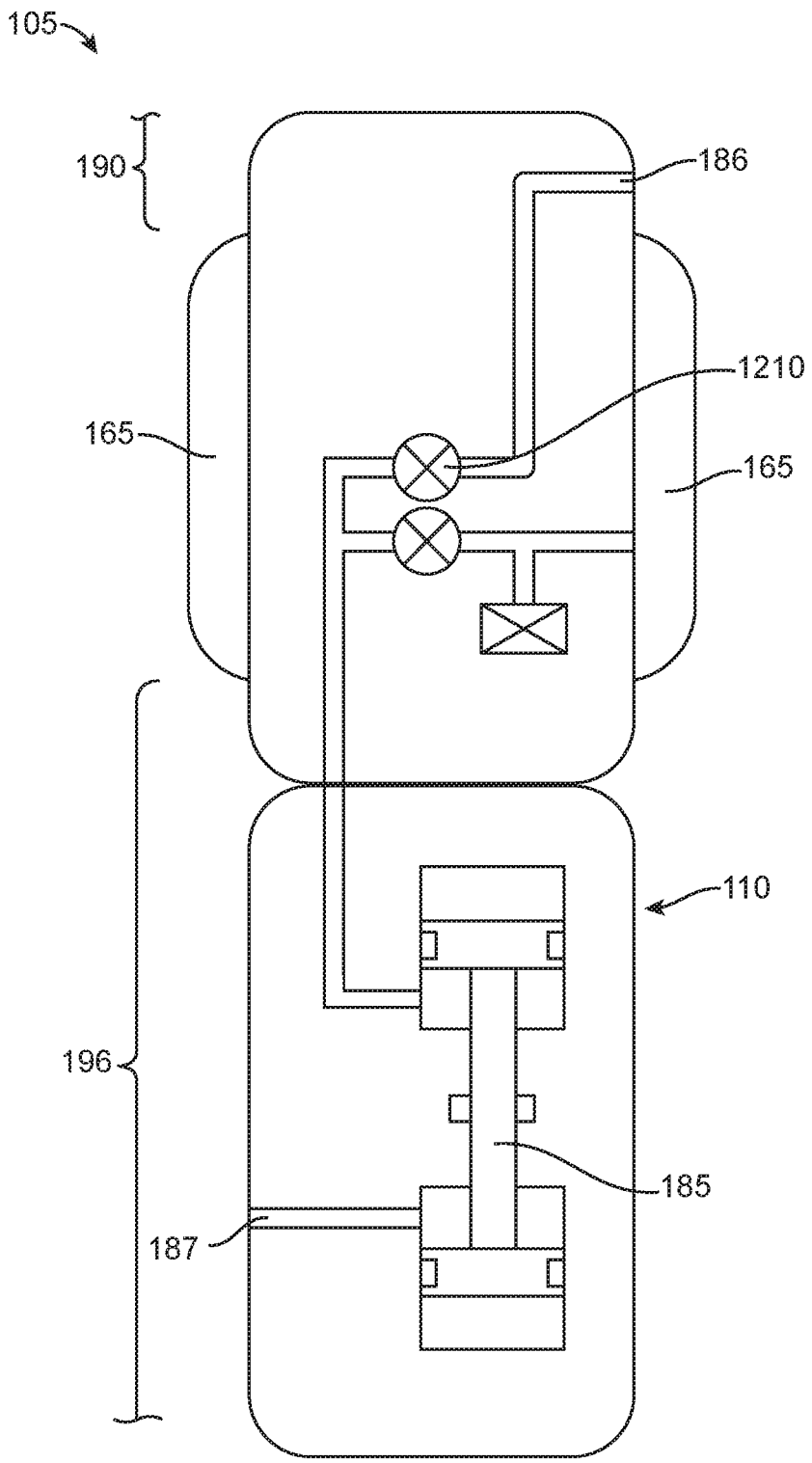
FIG. 12 is a cross-sectional view of a pump and sealing element coupled with a distal portion of a downhole core sampling apparatus, according to an exemplary embodiment.

FIG. 12 illustrates a cross-sectional view of a second pump 185 and second sealing element 165 coupled with a distal portion of the core sampling apparatus 105. As depicted in FIG. 12, the core sampling apparatus 105 additionally includes a second intake port 186 disposed along the inner isolatable portion 190 of the elongate housing 110. The second intake port 186 is fluidly coupled with a second exit port 187 disposed on a second outer portion 196 of the elongate housing 110. Optionally, the fluid coupling between the second intake port 186 and the second exit port 187 may include one or more valves 1210 configured to selectively permit and prevent flow of fluid between the second intake port 186 and the second exit port 187. A second pump 185 is operatively coupled with the second intake port 186 and the second exit port 182. The second pump 185 is configured to pump fluid from the second intake port 186 to the second exit port 187 when sealing elements 160, 165 are extended to isolate the isolatable portion 190 of the elongate housing 110 from the outer portions 195, 196 of the elongate housing 110. In a similar manner as the first pump 180, the pumping of second pump 185 flushes drilling fluid and other invasive fluids from the sample zones of interest in the portion of the wellbore isolated by the sealing elements 160, 165. The second pump 180 is further configured to pump fluid from the isolated portion of the wellbore 198 with sufficient pressure so as to draw formation fluid within the sample zones of interest toward the wall 145 of the wellbore 140 such that subsequent sampling of core samples from the sample zone of interest provides for core samples saturated with representative formation fluids.

According to at least one aspect of the present disclosure, the degree to which the fluids in the near wellbore environment have been sufficiently flushed, for example, to cause formation fluid to draw into the sample zones of interest, may be monitored using optical analyzers positioned near the first and second intake ports 181, 186 or near the first and second exit ports 182, 187. Alternatively, one or more optical analyzers may be operatively coupled with the first or second pumps 180, 185 or elsewhere in the fluid coupling between intake ports 181, 186 and exit ports 182, 187. Additionally, the optical analyzers may be configured to monitor fluid that has entered both the first and second intake ports 181, 186 in order to ensure effective flushing of the full wellbore region in the sampling zone of interest. Such optical analyzers may be used to determine when the fluids within the isolated area 198 of the wellbore 140 and adjacent to the isolatable portion 190 of the elongate housing 110 have been sufficiently flushed so as to likely provide for subsequent sampling of core samples saturated with representative formation fluids.

According to the present disclosure, a downhole core sampling apparatus insertable in a wellbore is provided. The apparatus includes an elongate housing, a first sealing member, and a second sealing member. The first and second sealing members are coupled with the elongate housing and spaced apart from one another along a longitudinal length of the elongate housing to form an isolatable portion of the elongate housing between the first sealing element and the second sealing element The first sealing element and the second sealing element are extendible substantially perpendicular to the longitudinal length of the elongate housing to engage a surface of the wellbore, thereby forming a sealed annulus region between the surface of the wellbore, the first sealing element, the second sealing element, and the isolatable portion of the elongate housing. The apparatus further includes a sidewall coring tool coupled with the isolatable portion of the elongate housing and further coupled with a core storage assembly having a chamber for storing a plurality of core samples. The sidewall coring tool has a coring bit extendible from the isolatable portion. The apparatus also includes a intake port along the surface of the isolatable portion for receiving fluid into an interior portion of the elongated housing. The apparatus further includes a pump coupled with the intake port and configured to draw fluid through the intake port into the interior portion of the elongate housing.

According to at least one aspect of the present disclosure, the apparatus can further include a first outer portion and a second outer portion, the first outer portion and the second outer portion spaced apart from one another along a longitudinal length of the elongate housing and separated from one another by the first sealing element, the second sealing element, and the isolatable portion of the elongate housing. The apparatus can further include an exit port disposed on one of the outer portions and fluidly coupled with the intake port and coupled with the pump. The exit port may be configured to expel fluid from the interior portion of the elongate housing.

According to at least one aspect of the present disclosure, the pump may be configured to pump fluid from the intake port to the exit port when the first sealing member and the second sealing member are extended to isolate the isolatable portion of the elongate housing from the first and the second outer portions.

According to at least one aspect of the present disclosure, the apparatus can further include a first outer portion and a second outer portion. In such cases, the first exit port is disposed on the first outer portion of the apparatus. The apparatus further includes a second intake port disposed along the inner isolatable portion of the apparatus and fluidly coupled with a second exit port disposed on the second outer portion of the apparatus. The apparatus further includes a second pump coupled with the second intake port and the second exit port. The second pump is configured to pump fluid from the second intake port to the second exit port when the first sealing member and the second sealing member are extended to isolate the inner isolatable portion of the apparatus from the first outer portion and second outer portion of the apparatus.

According to at least one aspect of the present disclosure, the apparatus can further include a plug configured to maintain pressure in the chamber. According to at least one aspect of the present disclosure, the core storage assembly can further include a plurality of disks sealingly engaged with an inner wall of the chamber so as to separate stored core samples. According to at least one aspect of the present disclosure, the core storage assembly can further include a heater configured to heat at least a portion of the core storage assembly. According to at least one aspect of the present disclosure, the core storage assembly of the apparatus can further include a piston configured to maintain an axial load on the one or more core samples stored in the chamber. According to at least one aspect of the present disclosure, the core storage assembly of the apparatus can further include a selectively inflatable bladder configured to maintain hydrostatic pressure on one or more core samples stored in the chamber.

According to the present disclosure, a method of obtaining fluid saturated downhole core samples is provided. The method includes disposing a downhole apparatus into a wellbore. The downhole apparatus includes a sidewall coring tool, a first sealing member, and a second sealing member. The method further includes extending the first sealing member and the second sealing member within a wellbore and sealing the first sealing member and the second sealing member against the wellbore. The first sealing member is longitudinally spaced from the second sealing member and defines an annular space between the first sealing member, the second sealing member and the wellbore. The method further includes pumping fluid out of the annular space through one or more ports disposed between the first sealing member and the second sealing member. The method further includes cutting at least one core sample from the sidewall of the wellbore.

According to at least one aspect of the present disclosure, the method further includes retracting the first sealing element and the second sealing element, moving the downhole apparatus to a second sampling location in the wellbore, extending the first sealing element and the second sealing element within a wellbore, and sealing the first sealing element and the second sealing element against the wellbore. The first sealing element is longitudinally spaced from the second sealing element and defines an annular space between the first sealing element, the second sealing element, and the wellbore. The method further includes pumping fluid out of the annular space through one or more ports disposed between the first sealing element and the second sealing element and cutting at least one core sample from the sidewall of the wellbore.

According to at least one aspect of the present disclosure, the method further includes an apparatus that includes a core storage assembly configured to store a plurality of core samples. According to at least one aspect of the present disclosure, the core storage assembly is further configured to store the plurality of core samples at sufficient hydrostatic pressure to maintain fluid saturation in the plurality of core samples. According to at least one aspect of the present disclosure, the method further includes cutting a plurality of core samples from the sidewall of the wellbore and storing the plurality of core samples in the core storage assembly. According to at least one aspect of the present disclosure, the pumping fluid out of the annular space includes pumping with sufficient force and for sufficient duration to cause the cut cores samples to be saturated with formation fluid.

According to the present disclosure, a system is provided. The system includes a downhole core sampling apparatus disposed within a wellbore. The downhole core sampling apparatus includes an elongate housing, a first sealing element, and a second sealing element coupled with the elongate housing. The first sealing element and the second sealing element are spaced apart from one another along a longitudinal length of the elongate housing to form an isolatable portion of the elongate housing between the first sealing element and the second sealing element. The first sealing element and the second sealing element are extendible substantially perpendicular to the longitudinal length of the elongate housing to engage a surface of the wellbore, thereby forming a sealed annulus region between the surface of the wellbore, the first sealing element, the second sealing element and the isolatable portion of the elongate housing. The apparatus may further include a sidewall coring tool coupled with the isolatable portion of the elongate housing. The sidewall coring tool may have a coring bit extendible from the isolatable portion. The apparatus may further include an intake port along the surface of the isolatable portion for receiving fluid into an interior portion of the elongated housing. The apparatus may further include a pump coupled with the intake port and configured to draw fluid through the intake port into the interior portion of the elongated housing.

According to at least one aspect of the present disclosure, the first sealing element and the second sealing element are each configured to form a seal with the wellbore, the respective seals defining an annular space between the first sealing element, the second sealing element, and the wellbore. The downhole core sampling apparatus further includes a sidewall coring tool coupled with a core storage assembly having a chamber for storing a plurality of cores samples. The sidewall coring tool is disposed longitudinally between the first sealing element and the second sealing element. The downhole core sampling apparatus further includes at least one pump configured to pump fluid out of the annular space.

According to at least one aspect of the present disclosure, the core storage assembly of the system further includes a plug configured to maintain pressure in the chamber. In at least one aspect of the present disclosure, the core storage assembly of the system further includes a plurality of disks sealingly engaged with an inner wall of the chamber so as to separate stored core samples. In at least one aspect of the present disclosure, the core storage assembly of the system further includes a heater configured to apply heat to core samples stored in the chamber. In at least one aspect of the present disclosure, the core storage assembly of the system further includes a piston configured to maintain an axial load on the one or more core samples stored in the chamber. In at least one aspect of the present disclosure, the core storage assembly of the system further includes a selectively inflatable bladder configured to maintain hydrostatic pressure on one or more core samples stored in the chamber.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims. Moreover, claim language reciting "at least one of" a set indicates that a system including either one member of the set, or multiple members of the set, or all members of the set, satisfies the claim.

Statements of the Disclosure Include:

Statement 1: A downhole core sampling apparatus insertable in a wellbore, the apparatus comprising: an elongate housing; a first sealing element and a second sealing element coupled with the elongate housing, the first sealing element and the second sealing element spaced apart from one another along a longitudinal length of the elongate housing to form an isolatable portion of the elongate housing between the first sealing element and the second sealing element; wherein the first sealing element and the second sealing element are extendible substantially perpendicular to the longitudinal length of the elongate housing to engage a surface of the wellbore, thereby forming a sealed annulus region between surface of the wellbore, the first sealing element, the second sealing element, and the isolatable portion of the elongate housing; a sidewall coring tool coupled with the isolatable portion of the elongate housing, the sidewall coring tool having a coring bit extendible from the isolatable portion; a core storage assembly disposed within the elongate housing and coupled with the coring tool, the core storage assembly having a chamber for receiving a plurality of core samples; an intake port along the surface of the isolatable portion for receiving fluid into an interior portion of the elongated housing; and a pump coupled with the intake port and configured to draw fluid through the intake port into the interior portion of the elongate housing.

Statement 2: A downhole core sampling apparatus according to Statement 1, further comprising: a first outer portion and a second outer portion, the first outer portion and the second outer portion spaced apart from one another along a longitudinal length of the elongate housing and separated from one another by the first sealing element, the second sealing element, and the isolatable portion of the elongate housing; and an exit port fluidly coupled with the intake port and coupled with the pump, the exit port disposed on one of the outer portions, wherein the exit port is configured to expel fluid from the interior portion of the elongate housing.

Statement 3: A downhole core sampling apparatus according to Statement 2, wherein the pump is configured to pump fluid from the intake port to the exit port when the first sealing member and the second sealing member are extended to isolate the isolatable portion of the elongate housing from the first and second outer portions.

Statement 4: A downhole core sampling apparatus according to Statement 2 or Statement 3, wherein the exit port is disposed on the first outer portion, the apparatus further comprising: a second intake port along the surface of the isolatable portion for receiving fluid into an interior portion of the elongated housing, the second intake port fluidly coupled with a second exit port disposed on the second outer portion and coupled with a second pump, wherein the second exit port is configured to expel fluid from the interior portion of the elongate housing.

Statement 5: A downhole core sampling apparatus according to any one of the preceding Statements 1-4, wherein the first and second sealing elements are expandable sealing elements, the extension of the first and second sealing elements comprising expansion of the first and second sealing elements.

Statement 6: A downhole core sampling apparatus according to any one of the preceding Statements 1-5, wherein the first and second sealing elements are each straddle packers.

Statement 7: A downhole core sampling apparatus according to any one of the preceding Statements 1-6, wherein the core storage assembly further comprises a plug configured to maintain pressure in the chamber.

Statement 8: A downhole core sampling apparatus according to any one of the preceding Statements 1-7, wherein the core storage assembly further comprises a plurality of disks sealingly engaged with an inner wall of the chamber so as to separate stored core samples.

Statement 9: A downhole core sampling apparatus according to any one of the preceding Statements 1-8, wherein the core storage assembly further comprises a heater configured to heat at least a portion of the core storage assembly.

Statement 10: A downhole core sampling apparatus according to any one of the preceding Statements 1-9, wherein the core storage assembly further comprises a piston configured to maintain an axial load on one or more core samples stored in the chamber.

Statement 11: A downhole core sampling apparatus according to any one of the preceding Statements 1-10, wherein the core storage assembly further comprises a selectively inflatable bladder configured to maintain hydrostatic pressure on one or more core samples stored in the chamber.

Statement 12: A downhole core sampling apparatus according to any one of the preceding Statements 1-11, further comprising an optical analyzer positioned near at least one of the intake port, the second intake port, the exit port, and the second exit port.

Statement 13: A downhole core sampling apparatus according to any one of the preceding Statements 1-12, wherein the chamber is coated with a coating that is unreactive with respect to one or more components of formation fluid.

Statement 14: A downhole core sampling apparatus according to any one of the preceding Statements 1-13, wherein the chamber is coated with an $Al_2O_3$ coating.

Statement 15: A downhole core sampling apparatus comprising: a first expandable sealing element and a second expandable sealing element, the first expandable sealing element longitudinally spaced from the second expandable sealing element; an inner isolatable portion between the first and second expandable sealing elements, the inner isolatable portion isolatable from at least one outer portion of the apparatus upon expansion of the first and second expandable sealing elements; a sidewall coring tool coupled along the inner isolatable portion of the apparatus and further coupled with a core storage assembly having a chamber for storing a plurality of core samples; a first intake port disposed along the inner isolatable portion of the apparatus and fluidly coupled with a first exit port disposed on an at least one of the outer portions of the apparatus; and a first pump operatively coupled with the first intake port and the first exit port, wherein the first pump is configured to pump fluid from the first intake port to the first exit port when the first expandable sealing element and the second expandable sealing element are expanded to isolate the inner isolatable portion of the apparatus from at least one outer portion of the apparatus.

Statement 16: A downhole core sampling apparatus according to Statement 15, further comprising: a first outer portion and a second outer portion, the first exit port disposed on the first outer portion of the apparatus; a second intake port disposed along the inner isolatable portion of the apparatus and fluidly coupled with a second exit port disposed on the second outer portion of the apparatus; and a second pump operatively coupled with the second intake port and the second exit port, wherein the second pump is configured to pump fluid from the second intake port to the second exit port when the first expandable sealing element and the second expandable sealing element are expanded to isolate the inner isolatable portion of the apparatus from the first outer portion and second outer portion of the apparatus.

Statement 17: A downhole core sampling apparatus according to Statement 15 or Statement 16, wherein the first and second expandable sealing elements are straddle packers.

Statement 18: A downhole core sampling apparatus according to any one of the preceding Statements 15-17, wherein the core storage assembly further comprises a plug configured to maintain pressure in the chamber.

Statement 19: A downhole core sampling apparatus according to any one of the preceding Statements 15-18, wherein the core storage assembly further comprises a plurality of disks sealingly engaged with an inner wall of the chamber so as to separate stored core samples.

Statement 20: A downhole core sampling apparatus according to any one of the preceding Statements 15-19, wherein the core storage assembly further comprises a heater configured to heat at least a portion of the core storage assembly.

Statement 21: A downhole core sampling apparatus according to any one of the preceding Statements 15-20, wherein the core storage assembly further comprises a piston configured to maintain an axial load on one or more core samples stored in the chamber.

Statement 22: A downhole core sampling apparatus according to any one of the preceding Statements 15-21, wherein the core storage assembly further comprises a selectively inflatable bladder configured to maintain hydrostatic pressure on one or more core samples stored in the chamber.

Statement 23: A downhole core sampling apparatus according to any one of the preceding Statements 15-22, further comprising an optical analyzer positioned near at least one of the first intake port, the second intake port, the first exit port, and the second exit port.

Statement 24: A downhole core sampling apparatus according to any one of the preceding Statements 15-23, wherein the chamber is coated with a coating that is unreactive with respect to one or more components of formation fluid.

Statement 25: A downhole core sampling apparatus according to any one of the preceding Statements 15-24, wherein the chamber is coated with an $Al_2O_3$ coating.

Statement 26: A downhole core sampling apparatus comprising: a sealing member capable of isolating an inner isolatable portion from an outer portion of the apparatus upon extension of the sealing element; a sidewall coring tool coupled along the inner isolatable portion of the apparatus and further coupled with a core storage assembly having a chamber for storing a plurality of core samples; an intake port disposed along the inner isolatable portion of the apparatus and fluidly coupled with an exit port disposed on the outer portion of the apparatus; and a pump operatively coupled with the intake port and the exit port, wherein the pump is configured to pump fluid from the intake port to the exit port when the sealing element is extended to isolate the inner isolatable portion of the apparatus from the outer portion of the apparatus.

Statement 27: A downhole core sampling apparatus according to Statement 26, wherein the sealing member is an expandable sealing element, the extension of the sealing element comprising expansion of the sealing element.

Statement 28: A downhole core sampling apparatus according to Statements 26 or Statement 27, wherein the sealing element is a straddle packer.

Statement 29: A downhole core sampling apparatus according to any one of the preceding Statements 26-28, wherein the core storage assembly further comprises a plug configured to maintain pressure in the chamber.

Statement 30: A downhole core sampling apparatus according to any one of the preceding Statements 26-29, wherein the core storage assembly further comprises a plurality of disks sealingly engaged with an inner wall of the chamber so as to separate stored core samples.

Statement 31: A downhole core sampling apparatus according to any one of the preceding Statements 26-30, wherein the core storage assembly further comprises a heater configured to heat at least a portion of the core storage assembly.

Statement 32: A downhole core sampling apparatus according to any one of the preceding Statements 26-31, wherein the core storage assembly further comprises a piston configured to maintain an axial load on one or more core samples stored in the chamber.

Statement 33: A downhole core sampling apparatus according to any one of the preceding Statements 26-32, wherein the core storage assembly further comprises a selectively inflatable bladder configured to maintain hydrostatic pressure on one or more core samples stored in the chamber.

Statement 34: A downhole core sampling apparatus according to any one of the preceding Statements 26-33, further comprising an optical analyzer positioned near at least one of the intake port and the exit port.

Statement 35: A downhole core sampling apparatus according to any one of the preceding Statements 26-34, wherein the chamber is coated with a coating that is unreactive with respect to one or more components of the formation fluid.

Statement 36: A downhole core sampling apparatus according to any one of the preceding Statements 26-35, wherein the chamber is coated with an $Al_2O_3$ coating.

Statement 37: A method of obtaining fluid saturated downhole core samples, the method comprising: disposing a downhole apparatus into a wellbore, wherein the downhole apparatus comprises a sidewall coring tool, a first sealing element, and a second sealing element; extending the first sealing element and the second sealing element within a wellbore; sealing the first sealing element and the second sealing element against the wellbore, the first sealing element longitudinally spaced from the second sealing element and defining an annular space between the first sealing element, the second sealing element and the wellbore; pumping fluid out of the annular space through one or more ports disposed between the first sealing element and the second sealing element; and cutting at least one core sample from the sidewall of the wellbore.

Statement 38: A method of obtaining fluid saturated downhole core samples according to Statement 37, further comprising: retracting the first sealing element and the second sealing element; moving the downhole apparatus to a second sampling location in the wellbore; extending the first sealing element and the second sealing element within a wellbore; sealing the first sealing element and the second sealing element against the wellbore, the first sealing element longitudinally spaced from the second sealing element and defining an annular space between the first sealing element, the second sealing element, and the wellbore; pumping fluid out of the annular space through one or more ports disposed between the first sealing element and the second sealing element; cutting at least one core sample from the sidewall of the wellbore.

Statement 39: A method of obtaining fluid saturated downhole core samples according to Statement 37 or Statement 38, wherein the first and second sealing elements are expandable sealing elements, the extending comprising expanding the first and second sealing elements and the retracting comprising deflating the first and second sealing elements.

Statement 40: A method of obtaining fluid saturated downhole core samples according to any one of the preceding Statements 37-39, further comprising analyzing the fluid to ensure effective flushing of a sampling zone of interest.

Statement 41: A method of obtaining fluid saturated downhole core samples according to any one of the preceding Statements 37-40, further comprising storing the plurality of core samples at sufficient hydrostatic pressure to maintain fluid saturation in the plurality of core samples.

Statement 42: A method of obtaining fluid saturated downhole core samples according to any one of the preceding Statements 37-41, wherein pumping fluid out of the annular space comprises sufficient force and for sufficient duration to cause the cut core samples to be saturated with formation fluid.

Statement 43: A method of obtaining fluid saturated downhole core samples according to any one of the preceding Statements 37-42, wherein the downhole apparatus further comprises a core storage assembly configured to store a plurality of core samples.

Statement 44: A method of obtaining fluid saturated downhole core samples according to Statement 43, wherein the core storage assembly is further configured to store the plurality of core samples at sufficient hydrostatic pressure to maintain fluid saturation in the plurality of core samples.

Statement 45: A method of obtaining fluid saturated downhole core samples according to Statement 43 or Statement 44, further comprising cutting a plurality of core samples from the sidewall of the wellbore and storing the plurality of core samples in the core storage assembly.

Statement 46: A method of obtaining fluid saturated downhole core samples, the method comprising: disposing a downhole apparatus into a wellbore, wherein the downhole apparatus comprises a sidewall coring tool, a first expandable sealing element, and a second expandable sealing element; expanding the first expandable sealing element and the second expandable sealing element within a wellbore; sealing the first expandable sealing element and the second expandable sealing element against the wellbore, the first expandable sealing element longitudinally spaced from the second expandable sealing element and defining an annular space between the first expandable sealing element, the second expandable sealing element and the wellbore; pumping fluid out of the annular space through one or more ports disposed between the first expandable sealing element and the second expandable sealing element; and cutting at least one core sample from the sidewall of the wellbore.

Statement 47: A method of obtaining fluid saturated downhole core samples according to Statement 46, further comprising: deflating the first expandable sealing element and the second expandable sealing element; moving the downhole apparatus to a second sampling location in the wellbore; expanding the first expandable sealing element and the second expandable sealing element within a wellbore; sealing the first expandable sealing element and the second expandable sealing element against the wellbore, the first expandable sealing element longitudinally spaced from the second expandable sealing element and defining an annular space between the first expandable sealing element, the second expandable sealing element, and the wellbore; pumping fluid out of the annular space through one or more ports disposed between the first expandable sealing element and the second expandable sealing element; cutting at least one core sample from the sidewall of the wellbore.

Statement 48: A method of obtaining fluid saturated downhole core samples according to Statement 46 or Statement 47, further comprising analyzing the fluid to ensure effective flushing of a sampling zone of interest.

Statement 49: A method of obtaining fluid saturated downhole core samples according to any one of the preceding Statements 46-48, further comprising storing the plurality of core samples at sufficient hydrostatic pressure to maintain fluid saturation in the plurality of core samples.

Statement 50: A method of obtaining fluid saturated downhole core samples according to any one of the preceding Statements 46-49, wherein pumping fluid out of the annular space comprises sufficient force and for sufficient duration to cause the cut core samples to be saturated with formation fluid.

Statement 51: A method of obtaining fluid saturated downhole core samples according to any one of the preceding Statements 46-50, wherein the downhole apparatus further comprises a core storage assembly configured to store a plurality of core samples.

Statement 52: A method of obtaining fluid saturated downhole core samples according to Statement 51, wherein the core storage assembly is further configured to store the plurality of core samples at sufficient hydrostatic pressure to maintain fluid saturation in the plurality of core samples.

Statement 53: A method of obtaining fluid saturated downhole core samples according to Statement 51 or Statement 52, further comprising cutting a plurality of core samples from the sidewall of the wellbore and storing the plurality of core samples in the core storage assembly.

Statement 54: A method of obtaining fluid saturated downhole core samples, the method comprising: disposing a downhole apparatus into a wellbore, wherein the downhole apparatus comprises a sidewall coring tool and a sealing element; extending the sealing element within a wellbore; sealing the sealing element against the wellbore, the sealing element defining an annular space between the sealing element and the wellbore; pumping fluid out of the annular space through one or more ports; and cutting at least one core sample from the sidewall of the wellbore.

Statement 55: A method of obtaining fluid saturated downhole core samples according to Statement 54, further comprising: retracting the sealing element; moving the downhole apparatus to a second sampling location in the wellbore; extending the sealing element within a wellbore; sealing the sealing element against the wellbore, the sealing element defining an annular space between the sealing element and the wellbore; pumping fluid out of the annular space through one or more ports; cutting at least one core sample from the sidewall of the wellbore.

Statement 56: A method of obtaining fluid saturated downhole core samples according to Statement 54 or Statement 55, wherein the sealing element is an expandable sealing element, the extending comprising expanding the sealing element and the retracting comprising deflating the sealing element.

Statement 57: A method of obtaining fluid saturated downhole core samples according to any one of the preceding Statements 54-56, further comprising analyzing the fluid to ensure effective flushing of a sampling zone of interest.

Statement 58: A method of obtaining fluid saturated downhole core samples according to any one of the preceding Statements 54-57, further comprising storing the plurality of core samples at sufficient hydrostatic pressure to maintain fluid saturation in the plurality of core samples.

Statement 59: A method of obtaining fluid saturated downhole core samples according to any one of the preceding Statements 54-58, wherein pumping fluid out of the annular space comprises sufficient force and for a sufficient duration to cause the cut core samples to be saturated with formation fluid.

Statement 60: A method of obtaining fluid saturated downhole core samples according to any one of the preceding Statements 54-59, wherein the downhole apparatus further comprises a core storage assembly configured to store a plurality of core samples.

Statement 61: A method of obtaining fluid saturated downhole core samples according to Statement 60, wherein the core storage assembly is further configured to store the plurality of core samples at sufficient hydrostatic pressure to maintain fluid saturation in the plurality of core samples.

Statement 62: A method of obtaining fluid saturated downhole core samples according to Statement 60 or Statement 61, further comprising cutting a plurality of core samples from the sidewall of the wellbore and storing the plurality of core samples in the core storage assembly.

Statement 63: A system comprising: a downhole core sampling apparatus disposed within a wellbore; the downhole core sampling apparatus comprising: an elongate housing; a first sealing element and a second sealing element, the first sealing element and the second sealing element spaced apart from one another along a longitudinal length of the elongate housing to form an isolatable portion of the elongate housing between the first sealing element and the second sealing element, wherein the first sealing element and the second sealing element are extendible substantially perpendicular to the longitudinal length of the elongate housing to engage a surface of the wellbore, thereby forming a sealed annulus region between the surface of the wellbore, the first sealing element, the second sealing element, and the isolatable portion of the elongate housing; a sidewall coring tool coupled with the isolatable portion of the elongate housing, the sidewall coring tool having a coring bit extendible from the isolatable portion; an intake port along the surface of the isolatable portion for receiving fluid into an interior portion of the elongated housing; and a pump coupled with the intake port and configured to draw fluid through the intake port into the interior portion of the elongated housing.

Statement 64: A system according to Statement 63, wherein the downhole core sampling apparatus further comprises a core storage assembly disposed within the elongate housing and coupled with the coring tool, the core storage assembly having a chamber for receiving a plurality of core samples.

Statement 65: A system according to Statement 63 or Statement 64, wherein the first and second sealing elements are expandable sealing elements.

Statement 66: A system according to any one of the preceding Statements 63-65, wherein the first and second sealing elements are straddle packers.

Statement 67: A system according to any one of the preceding Statements 63-66, wherein the core storage assembly further comprises a plug configured to maintain pressure in the chamber.

Statement 68: A system according to any one of the preceding Statements 63-67, wherein the core storage assembly further comprises a plurality of disks sealingly engaged with an inner wall of the chamber so as to separate stored core samples.

Statement 69: A system according to any one of the preceding Statements 63-68, wherein the core storage assembly further comprises a heater configured to heat at least a portion of the core storage assembly.

Statement 70: A system according to any one of the preceding Statements 63-69, wherein the core storage assembly further comprises a piston configured to maintain an axial load on the one or more core samples stored in the chamber.

Statement 71: A system according to any one of the preceding Statements 63-70, wherein the core storage assembly further comprises a selectively inflatable bladder configured to maintain hydrostatic pressure on one or more core samples stored in the chamber.

Statement 72: A system according to any one of the preceding Statements 63-71, further comprising an optical analyzer positioned near at least one of the intake port and the exit port.

Statement 73: A system according to any one of the preceding Statements 63-72, wherein the chamber is coated with a coating that is unreactive with respect to one or more components of the formation fluid.

Statement 74: A system according to any one of the preceding Statements 63-73, wherein the chamber is coated with an $Al_2O_3$ coating.

Statement 75: A system comprising: a wellbore; and a downhole core sampling apparatus comprising: a first expandable sealing element and a second expandable sealing element, the first expandable sealing element longitudinally spaced from the second expandable sealing element, wherein the first expandable sealing element and the second expandable sealing element are each configured to form a seal with the wellbore, the seals defining an annular space between the first expandable sealing element, the second expandable sealing element, and the wellbore; a sidewall coring tool coupled with a core storage assembly having a chamber for storing a plurality of cores samples, wherein the sidewall coring tool is disposed longitudinally between the first expandable sealing element and the second expandable sealing element; and at least one pump configured to pump fluid out of the annular space.

Statement 77: A system according to Statement 75, wherein the downhole core sampling apparatus further comprises at least one intake port disposed longitudinally between the first expandable sealing element and the second expandable sealing element and fluidly coupled to an exit port, the at least one pump operatively coupled with the intake port and the exit port.

Statement 77: A system according to Statement 75 or Statement 76, wherein the first and second expandable sealing elements are straddle packers.

Statement 78: A system according to any one of the preceding Statements 75-77, wherein the core storage assembly further comprises a plug configured to maintain pressure in the chamber.

Statement 79: A system according to any one of the preceding Statements 75-78, wherein the core storage assembly further comprises a plurality of disks sealingly engaged with an inner wall of the chamber so as to separate stored core samples.

Statement 79: A system according to any one of the preceding Statements 75-79, wherein the core storage assembly further comprises a heater configured to heat at least a portion of the core storage assembly.

Statement 81: A system according to any one of the preceding Statements 75-80, wherein the core storage assembly further comprises a piston configured to maintain an axial load on the one or more core samples stored in the chamber.

Statement 82: A system according to any one of the preceding Statements 75-81, wherein the core storage assembly further comprises a selectively inflatable bladder configured to maintain hydrostatic pressure on one or more core samples stored in the chamber.

Statement 83: A system according to any one of the preceding Statements 75-82, further comprising an optical analyzer positioned near at least one of the intake port and the exit port.

Statement 84: A system according to any one of the preceding Statements 75-83, wherein the chamber is coated with a coating that is unreactive with respect to one or more components of the formation fluid.

Statement 85: A system according to any one of the preceding Statements 75-84, wherein the chamber is coated with an $Al_2O_3$ coating.

Statement 86: A system comprising: a wellbore; and a downhole core sampling apparatus comprising: a sealing element configured to form a seal with the wellbore, the seal defining an annular space between the sealing element and the wellbore; a sidewall coring tool coupled with a core storage assembly having a chamber for storing a plurality of cores samples; and at least one pump configured to pump fluid out of the annular space.

Statement 87: A system according to Statement 86, wherein the downhole core sampling apparatus further comprises at least one intake port fluidly coupled to an exit port, the at least one pump operatively coupled with the intake port and the exit port.

Statement 88: A system according to Statement 86 or Statement 87, wherein the sealing element is an expandable sealing element.

Statement 89: A system according to any one of the preceding Statements 86-88, wherein the sealing element is a straddle packer.

Statement 90: A system according to any one of the preceding Statements 86-89, wherein the core storage assembly further comprises a plug configured to maintain pressure in the chamber.

Statement 91: A system according to any one of the preceding Statements 86-90, wherein the core storage assembly further comprises a plurality of disks sealingly engaged with an inner wall of the chamber so as to separate stored core samples.

Statement 92: A system according to any one of the preceding Statements 86-91, wherein the core storage assembly further comprises a heater configured to heat at least a portion of the core storage assembly.

Statement 93: A system according to any one of the preceding Statements 86-92, wherein the core storage assembly further comprises a piston configured to maintain an axial load on the one or more core samples stored in the chamber.

Statement 94: A system according to any one of the preceding Statements 86-93, wherein the core storage assembly further comprises a selectively inflatable bladder configured to maintain hydrostatic pressure on one or more core samples stored in the chamber.

Statement 95: A system according to any one of the preceding Statements 86-94, further comprising an optical analyzer positioned near at least one of the intake port and the exit port.

Statement 96: A system according to any one of the preceding Statements 86-95, wherein the chamber is coated with a coating that is unreactive with respect to one or more components of the formation fluid.

Statement 97: A system according to any one of the preceding Statements 86-96, wherein the chamber is coated with an $Al_2O_3$ coating.

We claim:

1. A downhole core sampling apparatus insertable in a wellbore, the apparatus comprising:

an elongate housing;

a first sealing element and a second sealing element coupled with the elongate housing, the first sealing element and the second sealing element spaced apart from one another along a longitudinal length of the elongate housing to form an isolatable portion of the elongate housing between the first sealing element and the second sealing element, wherein the first sealing element and the second sealing element are extendible substantially perpendicular to the longitudinal length of the elongate housing to engage a surface of the wellbore, thereby forming a sealed annulus region between the surface of the wellbore, the first sealing element, the second sealing element, and the isolatable portion of the elongate housing;

a sidewall coring tool coupled with the isolatable portion of the elongate housing, the sidewall coring tool having a coring bit extendible from the isolatable portion of the elongate housing and into a sidewall of the wellbore;

a core storage assembly disposed within the elongate housing and coupled with the coring tool, the core storage assembly having a pressurized chamber for receiving a plurality of formation fluid saturated core samples, the formation fluid having hydrogen sulfide and mercury therein and wherein the core chamber has a coating comprising $Al_2O_3$, wherein the core storage assembly comprises a piston configured to maintain an axial load on the plurality of formation fluid saturated core samples received in the pressurized chamber such that formation fluid is not lost from the core samples during the trip out of the wellbore, and wherein the pressurized chamber is unreactive to hydrogen sulfide or mercury;

an intake port along the surface of the isolatable portion for receiving fluid into an interior portion of the elongate housing; and a pump coupled with the intake port and configured to draw fluid through the intake port into the interior portion of the elongate housing at a sufficient force and for a sufficient duration to cause the sidewall to be saturated with formation fluid, the pump further coupled with the first sealing element or the second sealing element to actuate extension of the first sealing element or the second sealing element to engage a surface of the wellbore.

2. The downhole core sampling apparatus according to claim 1, further comprising:

a first outer portion and a second outer portion, the first outer portion and the second outer portion spaced apart from one another along a longitudinal length of the elongate housing and separated from one another by the first sealing element, the second sealing element, and the isolatable portion of the elongate housing; and an exit port fluidly coupled with the intake port and coupled with the pump, the exit port disposed on one of the outer portions, wherein the exit port is configured to expel fluid from the interior portion of the elongate housing.

3. The downhole core sampling apparatus according to claim 2, wherein the pump is configured to pump fluid from the intake port to the exit port when the first sealing member and the second sealing member are extended to isolate the isolatable portion of the elongate housing from the first and second outer portions.

4. The downhole core sampling apparatus according to claim 2, wherein the exit port is disposed on the first outer portion, the apparatus further comprising:

a second intake port along the surface of the isolatable portion for receiving fluid into an interior portion of the elongated housing, the second intake port fluidly coupled with a second exit port disposed on the second outer portion and coupled with a second pump, wherein the second exit port is configured to expel fluid from the interior portion of the elongate housing.

5. The downhole core sampling apparatus according to claim 1, wherein the first and second sealing elements are expandable sealing elements, the extension of the first and second sealing elements comprising expansion of the first and second sealing elements.

6. The downhole core sampling apparatus according to claim 1, wherein the first and second sealing elements are each straddle packers.

7. A method of obtaining formation fluid saturated downhole core samples, the method comprising:

disposing a downhole apparatus into a wellbore, wherein the downhole apparatus comprises a sidewall coring tool, a first sealing element, a second sealing element, and a core storage assembly, the core storage assembly coupled with the coring tool and having a chamber for receiving a plurality of formation fluid saturated core samples;

extending the first sealing element and the second sealing element within a wellbore a pump coupled with the first sealing element or the second sealing element operable to actuate the extending of the first sealing element or the second sealing element to engage a surface of the wellbore;

sealing the first sealing element and the second sealing element against the surface of the wellbore, the first sealing element longitudinally spaced from the second sealing element and defining an annular space between the first sealing element, the second sealing element and the surface of the wellbore;

pumping, via the pump, fluid out of the annular space through one or more ports disposed between the first sealing element and the second sealing element at a sufficient force and for a sufficient duration to cause the sidewall to be saturated with formation fluid;

cutting at least one formation fluid saturated core sample from the sidewall of the wellbore, the formation fluid having hydrogen sulfide and/or mercury therein; and storing a plurality of formation fluid saturated core samples within a pressurized chamber coated with a coating that is unreactive to hydrogen sulfide or mercury and pressurized at sufficient hydrostatic pressure to maintain fluid saturation in each of the plurality of formation fluid saturated core samples.

8. The method of claim 7, further comprising:

retracting the first sealing element and the second sealing element;

moving the downhole apparatus to a second sampling location in the wellbore;

extending the first sealing element and the second sealing element within a wellbore;

sealing the first sealing element and the second sealing element against the wellbore, the first sealing element longitudinally spaced from the second sealing element and defining an annular space between the first sealing element, the second sealing element, and the wellbore;

pumping fluid out of the annular space through one or more ports disposed between the first sealing element and the second sealing element;

cutting at least one core sample from the sidewall of the wellbore.

9. The method of claim 8, wherein the first and second sealing elements are expandable sealing elements, the extending comprising expanding the first and second sealing elements and the retracting comprising deflating the first and second sealing elements.

10. The method of claim 7, further comprising analyzing the fluid to ensure effective flushing of a sampling zone of interest.

11. The method of claim 7, wherein pumping fluid out of the annular space comprises sufficient force and for sufficient duration to cause the cut formation fluid saturated core samples to be saturated with formation fluid.

12. The method according to claim 7, wherein the coating comprises $Al_2O_3$.

13. A system comprising:

a downhole core sampling apparatus disposed within a wellbore, the apparatus comprising:

an elongate housing;

a first sealing element and a second sealing element coupled with the elongate housing, the first sealing element and the second sealing element spaced apart from one another along a longitudinal length of the elongate housing to form an isolatable portion of the elongate housing between the first sealing element and the second sealing element, wherein the first sealing element and the second sealing element are extendible substantially perpendicular to the longitudinal length of the elongate housing to engage a surface of the wellbore, thereby forming a sealed annulus region between the surface of the wellbore, the first sealing element, the second sealing element and the isolatable portion of the elongate housing;

a sidewall coring tool coupled with the isolatable portion of the elongate housing, the sidewall coring tool having a coring bit extendible from the isolatable portion of the elongate housing and into a sidewall of the wellbore;

a core storage assembly disposed within the elongate housing and coupled with the coring tool, the core storage assembly having a pressurized chamber for receiving a plurality of formation fluid saturated core samples, the formation fluid having hydrogen sulfide and/or mercury therein, wherein the core storage assembly comprises a piston configured to maintain an axial load on the plurality of formation fluid saturated core samples received in the pressurized chamber such that formation fluid is not lost from the core samples during the trip out of the wellbore, and wherein the pressurized chamber is coated with a coating that is unreactive to hydrogen sulfide or mercury;

an intake port along the surface of the isolatable portion for receiving fluid into an interior portion of the elongate housing; and a pump coupled with the intake port and configured to draw fluid through the intake port into the interior portion of the elongate housing at a sufficient force and for a sufficient duration to cause the sidewall to be saturated with formation fluid, the pump further coupled with the first sealing element or the second sealing element to actuate extension of the first sealing element or the second sealing element to engage a surface of the wellbore.

14. The system according to claim 13, wherein the coating comprises $Al_2O_3$.

* * * * *